US006915964B2

(12) United States Patent
Tapphorn et al.

(10) Patent No.: US 6,915,964 B2
(45) Date of Patent: Jul. 12, 2005

(54) SYSTEM AND PROCESS FOR SOLID-STATE DEPOSITION AND CONSOLIDATION OF HIGH VELOCITY POWDER PARTICLES USING THERMAL PLASTIC DEFORMATION

(75) Inventors: Ralph M. Tapphorn, Goleta, CA (US); Howard Gabel, Santa Barbara, CA (US)

(73) Assignee: Innovative Technology, Inc., Goleta, CA (US)

( * ) Notice: Subject to any disclaimer, the term of this patent is extended or adjusted under 35 U.S.C. 154(b) by 302 days.

(21) Appl. No.: 10/116,812

(22) Filed: Apr. 5, 2002

(65) Prior Publication Data

US 2002/0168466 A1 Nov. 14, 2002

Related U.S. Application Data

(60) Provisional application No. 60/286,256, filed on Apr. 24, 2001.

(51) Int. Cl.[7] ..... B05B 1/24

(52) U.S. Cl. ..... 239/128; 239/134; 239/135; 239/416.5; 239/372

(58) Field of Search ..... 239/128, 134, 239/135, 398, 416.5, 266, 366, 368, 369, 372, 602, 592–594; 427/446

(56) References Cited

U.S. PATENT DOCUMENTS

| | | | |
|---|---|---|---|
| 2,714,563 | A | 8/1955 | Poorman et al. |
| 3,601,578 | A | 8/1971 | Gebel et al. |
| 3,899,306 | A | 8/1975 | Knopp et al. |
| 3,914,573 | A | 10/1975 | Muehlberger |
| 3,951,328 | A | 4/1976 | Wallace et al. |
| 3,970,237 | A | 7/1976 | Dockus |
| 4,256,779 | A | 3/1981 | Sokol et al. |
| 4,328,257 | A | 5/1982 | Muehlberger et al. |
| 4,471,034 | A | 9/1984 | Romero et al. |
| 4,689,468 | A | 8/1987 | Muehlberger |
| 4,723,378 | A | 2/1988 | VanKuiken, Jr. et al. |
| 4,732,311 | A | 3/1988 | Hasegawa et al. |
| 4,841,114 | A | 6/1989 | Browning |
| 4,877,640 | A | 10/1989 | Muehlberger et al. |
| 5,035,089 | A | 7/1991 | Tillman et al. |
| 5,070,228 | A | 12/1991 | Siemers et al. |
| 5,298,714 | A | 3/1994 | Szente et al. |
| 5,302,414 | A | 4/1994 | Alkhimov et al. |

(Continued)

FOREIGN PATENT DOCUMENTS

| | | |
|---|---|---|
| JP | 60078205 | 5/1985 |
| RU | 1773072 | 10/1995 |
| WO | WO 00/52228 | 9/2000 |

OTHER PUBLICATIONS

D. J. Field et al. "Composite Deposition (CD) Technology—A Novel Joining Process for Automotive Heat Exchanger". Paper 35—Proceedings of T & N Leading through innovation Symposium, Wurzburg–Indianapolis, IN 1995.

M. Laroussi et al. Jun. 1996, "Sterilization of Contaminated Matter with an Atmospheric Pressure Plasma" IEEE Trans. On Plama Science, vol. 24, No. 3, pp. 1188–1191.

*Primary Examiner*—Davis Hwu
(74) *Attorney, Agent, or Firm*—Lyon & Harr, LLP; Richard T. Lyon

(57) ABSTRACT

The invention relates to an apparatus and process for solid-state deposition and consolidation of powder particles entrained in a subsonic or sonic gas jet onto the surface of an object. Under high velocity impact and thermal plastic deformation, the powder particles adhesively bond to the substrate and cohesively bond together to form consolidated materials with metallurgical bonds. The powder particles and optionally the surface of the object are heated to a temperature that reduces yield strength and permits plastic deformation at low flow stress levels during high velocity impact, but which is not so high as to melt the powder particles.

36 Claims, 14 Drawing Sheets

U.S. PATENT DOCUMENTS 5,312,475 A 5/1994 Purnell et al.
5,637,242 A 6/1997 Muehlberger
5,705,786 A 1/1998 Solomon et al.
5,766,693 A 6/1998 Rao
5,795,626 A 8/1998 Gabel et al.
5,833,891 A * 11/1998 Subramaniam et al. ..... 264/7
5,884,388 A 3/1999 Patrick et al.
5,961,772 A 10/1999 Selwyn
5,980,650 A 11/1999 Belt et al.
6,002,096 A 12/1999 Hoffelner et al.
6,074,135 A 6/2000 Tapphorn et al.
6,084,196 A 7/2000 Flowers et al.
6,139,913 A 10/2000 Van Steenkiste et al.

* cited by examiner

SYSTEM AND PROCESS FOR SOLID-STATE DEPOSITION AND CONSOLIDATION OF HIGH VELOCITY POWDER PARTICLES USING THERMAL PLASTIC DEFORMATION

CROSS-REFERENCE TO RELATED APPLICATIONS

This application claims the benefit of a previously-filed provisional patent application Ser. No. 60/286,256, filed on Apr. 24, 2001.

BACKGROUND

1. Technical Field

The present invention relates to an apparatus and process for solid-state deposition and consolidation of high velocity powder particles entrained in a subsonic or sonic gas jet onto a substrate material. Upon impact the powder particles undergo plastic deformation which permits adhesive bonding to the substrate and inter-particle metallurgical bonding. This adhesive and cohesive bonding permits coatings of substrates and spray forming of near net shape components and parts. The basic embodiment of the invention uses a friction-compensated sonic nozzle to accelerate powder particles to high velocities with several methods for heating (thermal-plastic conditioning) the powder particles and substrate to temperatures sufficiently high to reduce the yield strength during impact and permit plastic deformation at low flow stress levels. One method of the heating the powder particles and substrate uses an ambient pressure thermal-transfer plasma between the nozzle exit and the substrate. A complementary embodiment of the invention uses a powder reactor to alter the physical, chemical, or nuclear properties of powder particles prior to injection into a friction-compensated sonic nozzle for acceleration.

The solid-state deposition and consolidation process of the invention relates to a method for thermal-plastic conditioning or heating of the powder particles and substrate materials to reduce their yield strengths and permit plastic deformation at low flow stress levels during high velocity impact. This is accomplished at temperatures well below the melting points of said powder particles and substrate materials.

2. Background Art

The coating applicator and process disclosed in U.S. Pat. No. 5,795,626 issued to Gabel and Tapphorn has a low deposition efficiency, which is attributed to the high elastic response of triboelectrically charged powder particles at ambient temperature that have not been thermal plastically conditioned to induce plastic deformations. This elastic response tends to mechanically reflect the majority of impacting particle, which precludes significant adhesion or cohesion.

This is particularly true for large diameter particles, hard substrates, or work hardened depositions and substrates. Thus, the coating applicator and process disclosed in U.S. Pat. No. 5,795,626 is not economically viable for commercial applications without thermal plastically conditioning the powder particles to induce plastic deformations. Limitations to the prior art were overcome in U.S. Pat. No. 6,074,135 issued to Tapphorn and Gabel, which disclosed various methods for fluidizing and treating powder particles at high carrier gas pressures prior to injection into a supersonic applicator. U.S. Pat. Nos. 5,795,626 and 6,074,135 both describe a coating or ablation applicator that uses supersonic nozzles to accelerate triboelectrically charged powder particles in a supersonic carrier gas. Supersonic nozzles, however are extremely inefficient for accelerating powder particles to high speeds because the flow expansion process for achieving high supersonic gas speeds inherently decreases the drag force on the powder particles. The reduction in drag force is due to the precipitous decrease in gas density that accompanies the supersonic acceleration of the gas during expansion. Thus, the new art of this invention is required to enhance the solid-state consolidation processes to make it more economically attractive for commercial applications while minimizing in-situ oxidation and unwanted chemically reactivity during the deposition.

Thermal spray, plasma spray, and detonation coating methods (e.g., U.S. Pat. No. 2,714,563 issued to Poorman et al., U.S. Pat. No. 3,914,573 issued to Muehlberger, U.S. Pat. No. 4,256,779 issued to Sokal et al., U.S. Pat. No. 4,732,311, U.S. Pat. No. 4,841,114 issued to Browning, U.S. Pat. No. 5,298,714 issued to Szente et al., and U.S. Pat. No. 5,637,242 issued to Muehlberger) all use extremely high temperature gases to thermally soften or melt powder particles as the primary consolidation mechanism to achieve practical deposition efficiencies. More importantly, the thermal and plasma spray processes all disperse the thermally soften or melt powder particles over a broad solid-angle cone at large standoff distances that permits air and unwanted gases to be entrained in the spray effluent leading to high levels of oxidation and chemical combustion particularly for reactive metal powders such as aluminum, magnesium, or titanium.

The high velocity methods identified in U.S. Pat. Nos. 2,714,563, 3,914,573, 4,256,779, 4,732,311, 5,637,242, 5,766,693 issued to Rao, and RU Patent 1773072 issued to Alkhimov et al., disclose the advantage of using high velocity particles in addition to thermally softened or melted particle states for enhanced deposition efficiency and improved coating properties.

In contrast, the reexamined coating patent (U.S. Pat. No. 5,302,414B1) issued to Alkhimov et al. restricts the gas-dynamic spraying method to accelerating the gas and particles into a supersonic jet at particles temperatures sufficiently low so as to prevent thermal softening or melting of said particles. Although the thermal softening temperature is not adequately defined in the Alkhimov et al. patent the process is specified to be much below the melting point of the material. Specific examples in the specification indicate that the deposited material does not exceed 100° C. Thus, the Alkhimov et al. patent is limited in its claims in terms of controlling the consolidation physical state of the applied coatings and the process results in coatings with low deposition efficiency and high residual stresses. A more recent U.S. Pat. No. 6,139,913, issued to Van Steenkiste et al. claims improvements to U.S. Pat. No. 5,302,414B1 by including particle sizes in excess of 50 microns. This patent also accelerates gas and particles into a supersonic jet while maintaining the temperature of the gas and particles sufficiently low to prevent thermal softening of the particles. Both of these patents restrict the prior art to applications using supersonic jets.

Plasma spray guns disclosed in U.S. Pat. Nos. 3,914,573, 4,256,779, 4,689,468 issued to Muehlberger, U.S. Pat. Nos. 4,841,114, and 5,637,242 all inject the powder particles into a plasma stream typically at the throat of a nozzle designed to flow a supersonic plasma jet. U.S. Pat. No. 5,298,714 issued to Szente, et al. discloses a plasma torch or gun for deposition of particles onto a substrate in which the particles are injected at the inlet to the nozzle. U.S. Pat. Nos. 3,914,573, 4,841,114, and 5,766,693 specifically disclose methods for thermally softening or eliminating excessive heating of powder particles in a plasma gun, where the particles are heated after expansion of the supersonic plasma stream gas through a converging-diverging nozzle. All of the prior art plasma guns are configured to pass the ionized high-temperature plasma through an outlet or supersonic nozzle prior to deposition on the substrate. This approach precludes in-situ low temperature control of the powder consolidation state in close proximity to the substrate impingement point. In fact, U.S. Pat. No. 4,256,779 requires supplemental cooling of the substrate in order to avoid overheating. Furthermore, the supersonic flow specified in the prior art is very inefficient in terms of accelerating powder particles. This is particularly true once the flow begins the rapid expansion to ambient pressure in the divergent section of a supersonic nozzle. Thus the prior art restricts significant particle acceleration to the short, relatively low velocity, converging section, and the very short throat section of the nozzle. The complexity, inherent in the prior art in plasma guns, increases the cost of these devices for commercial applications. More importantly these conventional plasma guns wastes a large quantities of energy in the form of heat that must be carried away by the cooling water used to keep the electrodes and nozzles from melting or eroding.

Plasma cutting torches (e.g., U.S. Pat. No. 6,002,096 issued to Hoffelner et al.) frequently use a DC transfer-arc to melt or burn (oxidize) a substrate, but this prior art is restricted to cutting applications and does not claim a method for coating, spray forming, joining, or fusing materials using entrained powder particles in the carrier gas. Applications using plasma transfer-arc torches with filler metal powders entrained in the plasma gas are disclosed in U.S. Pat. No. 5,705,786 issued to Solomon et al. and U.S. Pat. No. 6,084,196 issued to Flowers et al. to weld various substrates. U.S. Pat. No. 4,471,034 issued to Romero et al. teaches a method for applying a weld-bonded coating to cast iron parts using a transfer-arc plasma torch. Most of the plasma transfer-arc torches use conventional prior art with a central electrode surrounded by a concentric electrode to generate an arc in the circumferential passageway between the electrodes. U.S. Pat. No. 5,070,228 issued to Siemers et al. generates a plasma plume via a RF coaxial induction coil surrounding the plasma cavity. Powders entrained in the plasma gas or a separate carrier gas (generally argon) are introduced into the arc or plasma to melt the particles. Thus, ionization of the plasma gas occurs internal to the plasma torch or gun with powder particles introduced at low velocities into the plasma stream within the torch or gun housing or adjacent to the plasma stream immediate to the exit orifice.

Plasma heaters and burners have been used to heat and ionized gas (e.g., U.S. Pat. No. 3,601,578 issued to Gebel et al.) and to improve combustion efficiency (e.g., JP 60078205 A issued to Toshiharu), but such devices have not been used to thermally treat particles prior to depositions of coatings. U.S., Pat. No. 5,766,693 discloses a method for applying metal base coatings using a conventional plasma spray gun in which particles are injected into the supersonic jet at temperatures that plasticize the particles, but do not melt the material. External cooling of the substrate is required for this device in order to prevent overheating of the coating and workpiece.

U.S. Pat. Nos. 4,328,257, 4,689,468, 4,877,640 and 5,070,228 issued to Siemers et al. disclose various techniques for electrically coupling a high temperature and plasma stream to the workpiece or substrate using a DC power supply of a given polarity connected between the plasma gun and the target workpiece. These patents teach the use of a high current DC transfer-arc process to preheat the substrate surface, reduce oxide contamination of plasma coatings, or to remove oxide coatings from the metallic particles traveling in the plasma stream. These patents do not teach a method for controlling the deposition and consolidation states of coatings at temperatures below the material melting point. Furthermore, these low-pressure plasma guns or torches have the commercial disadvantage of requiring costly vacuum chambers and equipment to produce the plasma stream.

Thermal softening nomenclature has been used in U.S. Pat. No. 3,914,573 issued to Muehlberger to describe the physical state of powder particles heated to temperatures near the melting point, but below melting. This patent asserts that an optimum particle temperature exists for each specific material. If this temperature is exceeded the particle can spatter upon impact with the workpiece. If the temperature of the particle is too low, insufficient deformation of the particle occurs upon impact resulting in poor quality coatings with poor bonds. The Muehlberger patent further asserts that the addition of thermal energy to the kinetic energy of the particle results in greater deformation of the particles upon impact. Thus the temperature of the particle in combination with the kinetic energy is critical to attain sufficient particle deformation leading to high deposition efficiency, high bond strength, and low porosity.

Two other patents, U.S. Pat. No. 5,766,693 to Rao and U.S. Pat. No. 4,256,779 to Sokol et al. use the term "plasticized" to describe a powder particle temperature state near the melting point of the particle. U.S. Pat. No. 5,766,693 restricts the melted or plasticized state substantially to the surface region of each particle. Sokol, et al. teaches in U.S. Pat. No. 4,256,779 a method for heat-softening or plasticizing powder particles. The powder is injected into a temperature controlled plasma stream to heat-soften or plasticize, but not for a sufficient time to liquefy or vaporize. By inference both of these patents teach a method that is consistent with U.S. Pat. No. 3,914,573 issued to Muehlberger in which the powder particles are heated to temperatures near the melting point.

Other patents teach a broader definition for thermal softening of materials. For example, U.S. Pat. No. 5,312,475 issued to Purnell et al. teach a method for adding submicroscopic carbides to give a resistance to thermal softening of sintered metal materials. This patent reports hardness data for sintered ferrous material that decreases monotonically with increasing temperature of the material from room temperature to 773 Kelvin (500 degrees Celsius). Thus, the thermal softening is demonstrated to have significant effects on mechanical hardness at temperatures significantly below the melting point of iron alloys (i.e., melting point typically in excess of 1500 degrees Celsius).

The objective of the present invention is to overcome the limitations of the prior art by teaching a method for treating the powder particles to alter their physical, chemical, or nuclear properties prior to deposition and consolidation of the solid-state powder particles. The deposition and consolidation process uses a friction-compensated sonic nozzle to accelerate said treated powder particles to high velocity in a subsonic or sonic inert carrier-gas stream in order to apply a coating treatment of an object or to spray form an object. Additionally, the object of the present invention relates to a new method and process for applying various multi-layer coatings, functionally graded materials, functionally formed in-situ composites, and ex-situ composites onto substrates for surface modification and consolidation. The invention also teaches a spray forming method for consolidating powders (metallic, nonmetallic or mixtures thereof) onto a substrate surface while controlling the metallurgical, chemical, or mechanical properties of the substrate and consolidated material. Limitations of conventional thermal and plasma spray techniques are overcome with the present invention by using an inert carrier gas formed into a directed subsonic or sonic jet that significantly reduces oxidation and chemical combustion of nearly molten or molten powder particles (near the melting point of powder particle material) during the deposition and consolidation process. Reduction of oxidation and chemical combustion of the powder particles is achieved because the process reduces mixing and entrainment of air and unwanted gases into the directed jet of inert gas prior to deposition or consolidation on the object at relatively short standoff distances. The invention also provides the means of using a surrounding inert gas shield to further reduce or eliminate entrainment of air or unwanted gases into the directed jet of inert carrier gas. Finally, the invention reduces oxidation and chemical combustion of the powder particles even further by thermal plastically conditioning the powder particles within an inert carrier-gas environment at relatively low temperatures compared to nearly molten (near the melting point of powder particle material) or molten powder particles temperatures used in conventional thermal and plasma spray methods.

Aluminum alloys frequently require coatings for corrosion protection, wear resistance, optical reflectivity, soldering, brazing, welding, machining, and polishing. These coatings must be applied while controlling the metallurgical, chemical or mechanical properties of the substrate and deposited material.

Conventionally, products such as aluminum heat exchangers are manufactured using aluminum braze sheet. The braze sheets is clad with a eutectic outer layer. Aluminum brazing techniques are adequately reviewed in the Aluminum Brazing Handbook [The Aluminum Association, 900 19$^{th}$ Street, NW, Washington, D.C. 4$^{th}$ Edition 1998]. The brazing process consists of wetting the aluminum alloys to be joined with a filler material (e.g., typically 4000 series aluminum-silicon alloys) that enables metallurgical bonding of the joint.

Cladding techniques have been used for modifying the surface of aluminum alloys for many applications, but the process is costly and is primarily amenable to sheet stock. U.S. Pat. No. 3,899,306 issued to Knopp, et al. discloses a method for brazing aluminum parts by applying a thin layer of nickel powder (unconsolidated) between the adjacent surfaces of a pair of parts that are pressed together and heated to a temperature of 537 to 650° C., but below the melting point of said parts. U.S. Pat. No. 3,970,237 issued to Dockus, et al. discloses a method of brazing aluminum parts where clad filler (e.g., aluminum silicon alloy) is plated with a bond-promoting alloy (e.g., nickel-lead or cobalt-lead) between the aluminum parts to enable the brazing process. This patent also teaches the same method of brazing aluminum to braze other materials including steel, aluminized steel, stainless steel, or titanium.

Attempts to use thermal and plasma spray methods for depositing thermally softened or molten braze alloys onto aluminum alloys as disclosed in U.S. Pat. No. 4,732,311 issued to Hasegawa et al. have been largely unsuccessful because of low adhesion (which causes flaking of the coating material during subsequent forming steps). Other factors include 1) oxidation, 2) metallurgical alteration of the substrate induced by undesirable heat treatment, 3) metallurgical alteration of the substrate induced by undesirable diffusion of contaminates, 4) thermal and mechanical distortion of the substrate, and 5) other chemical reactivity.

Flux materials, such as potassium fluoro-aluminate salts (International Patent, WO 00/52228 issued to Kilmer, U.S. Pat. No. 3,951,328 issued to Wallace et al., and U.S. Pat. No. 5,980,650 issued to Belt et al.), are applied to the surface of the eutectic clad as a braze bond-promoting substance that displace the oxide from the surface of the aluminum, lower the filler metal's surface tension, and promote base metal wetting and filler metal flow. These coatings are conventionally applied by spraying a liquid mixture of the potassium fluoro-aluminate salt in water or as a composite powder comprising a potassium fluoro-aluminate salt coated on the surface of the eutectic aluminum-silicon alloy powder [Field, D. J., Krafft, R. G., and Hawksworth, D. K. "Composite Deposition (CD) Technology—A Novel Joining Process for Automotive Heat Exchangers." Paper 35-Proceedings of T&N Leading through Innovation Symposium, Wurzburg-Indianapolis, Ind., 1995]. In other cases, thin nickel or cobalt coatings have been used as bond-promoting flux coatings as disclosed in U.S. Pat. No. 3,899,306 issued to Knopp, et al. and U.S. Pat. No. 3,970,237 issued to Dockus, et al.

U.S. Pat. No. 5,884,388 issued to Patrick et al. discloses prior art for applying a friction-wear coating to a substrate such as a brake rotor. This patent claim's technique for heating the substrate and machining grooves to enhance bonding of a wire-arc spray formed layer. All of the surface preparation and substrate heating processes unique to U.S. Pat. No. 5,884,388 are required to cope with the oxidation of the substrate and coating deposit which reduces adhesion/cohesion. The extensive surface preparations portend a mechanical bond rather than a metallurgical bond.

SUMMARY

The present invention relates to an apparatus and process for solid-state deposition and consolidation of powder particles entrained in a subsonic or sonic gas jet onto a substrate material. Under high velocity impact and thermal plastic deformation, the powder particles adhesively bond to the substrate and cohesively bond together to form a consolidated coating or spray formed part with interatomic or metallurgical bonding structure at the interfaces. Upon impact the powder particles undergo plastic deformation which permits adhesive bonding to the substrate and interparticle metallurgical bonding. This adhesive and cohesive bonding permits coatings of substrates and spray forming of near net shape components and parts. The basic embodiment of the invention uses a friction-compensated sonic nozzle to accelerate powder particles to high velocities with several methods for thermal-plastic conditioning or heating the powder particles and substrate to temperatures sufficiently high to reduce the yield strength during impact and permit plastic deformation at low flow stress levels. One method of thermal-plastic conditioning or heating the powder particles and substrate uses ambient pressure thermal-transfer plasma between the nozzle exit and the substrate at relatively short standoff distances. A complementary embodiment of the invention uses a powder reactor to alter the physical, chemical, or nuclear properties of powder particles prior to injection into a friction-compensated sonic nozzle for acceleration. The powder reactor was first disclosed in U.S. Pat. No. 6,074,135 issued to the present inventors for application with supersonic jets and nozzles, and are extended to the present invention for application with friction-compensated sonic nozzles.

Simultaneously coupling the kinetic energy of the particles transferred to the impact process with the reduction in yield strength of said powder particles and substrate, induced by heating (thermal-plastic conditioning), permit solid-state deposition and consolidation of coatings, spray forming of parts, or joining of various materials via thermally dependent plastic deformation. By controlling the velocity of the impact process in combination with thermal-plastic conditioning the material properties can be tailored to specific requirements. For example, the severe plastic deformation induced by the impact process is responsible for the creation of observed nanostructures within the microstructure of the consolidated powder particles. Thermal plastic conditioning of the powder particles allows these nanostructures to be modified through enhanced dynamic recovery of dislocation densities. In addition, the chemical potentials of the consolidated materials are modified by high-pressure confinements induced by residual stresses associated with severe plastic deformation. These modified chemical potentials effect the chemical reaction rates for controlling the properties of metal matrix composite functionally formed during in-situ fabrication of strengthening phases within a metallic matrix. This process yields high quality consolidations with low porosity, low oxidation, and minimal thermal distortion. The process also yields depositions with unique nanostructure and microstructure and permits spray forming, joining, and fusing of various materials. The deposition is sprayed over the substrate by translating the friction-compensated sonic nozzle in raster fashion over the substrate at relatively short standoff distances and at speeds that permit depositions and consolidations to a desired thickness. More intelligent translations of a plurality of friction-compensated sonic nozzles under robotic control permit rapid sterolithographic formation of near net shape parts and components.

The types of powder particles that can be entrained in a subsonic or sonic gas jet using the apparatus and process of this invention are selected from a group but are not limited to powders consisting of metals, alloys, low temperature alloys, high temperature alloys, superalloys, braze fillers, metal matrix composites, nonmetals, ceramics, polymers, and mixtures thereof. Indium or tin-based solders and silicon based aluminum alloys (e.g., 4043, 4045, or 4047) are examples of low temperature alloys that can be deposited and consolidated in the solid-state for coatings, spray forming, and joining of various materials using the apparatus and process of this invention. High temperature alloys include, but are not limited to NF616 (9Cr-2W—Mo—V—Nb—N), SAVE25 (23Cr-18Ni—Nb—Cu—N), Thermie (25Cr-20Co-2Ti-2Nb—V—AI), and NF12 (11Cr-2.6W-2.5Co—V—Nb—N). Superalloys include nickel, iron-nickel, and cobalt-based alloys disclosed on page 16–5 of Metals Handbook, Desk Edition 1985, American Society for Metals, Metals Park, Ohio 44073. Powder particles coated with another metal such as nickel and cobalt coated tungsten powders are also included as a special type of composite powder that can be used with apparatus and process of the invention.

The preferred powder particle size for the apparatus and process of this invention is generally a broad distribution with an upper limit of −325 mesh (<45 micrometers). Powder particles sizes in excess of 325 mesh (45 micrometers) are frequently selected as strengthening agents for co-deposition with a matrix material for forming metal matrix composites or forming a porous consolidation with high porosity. Powder particle sizes in the nanoscale regime can also be deposited and consolidated with apparatus and process of this invention.

The types of substrate materials that can be coated or used for deposition and consolidation surfaces with apparatus and process of the invention are selected from a group but are not limited to materials consisting of metals, alloys, low temperature alloys, high temperature alloys, superalloys, metal matrix composites, nonmetals, ceramics, polymers, and mixtures thereof.

The applicator uses an outer evacuator chamber and an optional outer coaxial evacuator nozzle surrounding the friction-compensated sonic nozzle for retrieving excess powder particles and debris using a conventional dust collector. The outer evacuator chamber and optional outer coaxial evacuator nozzle reduces the entrainment of air and unwanted gases into the directed subsonic or sonic jet of inert carrier gas and also permit the nozzle gases to be captured and recycled for environmental and economic purposes. Finally, a powder fluidizing unit (first disclosed in U.S. Pat. No. 6,074,135 issued to the present inventors for application with supersonic jets and nozzles) for fluidizing, entraining, and mixing the powder particles within the carrier gas is included in the invention and is applicable to the friction-compensated sonic nozzle.

The solid-state deposition and consolidation process of the invention relates to a method for thermally altering the powder particles and substrate materials to reduce their yield strengths and permit plastic deformation at low flow stress levels during high velocity impact. This is accomplished at temperatures well below the melting points of said powder particles and substrate materials.

The modulus of rigidity (G) is related to the modulus of elasticity (E) through the well know relationship $G=E/(2(1+\nu))$ where $\nu$ is Poisson's ratio. Any reduction in the modulus of rigidity, induced by heating, promotes enhanced elastic deformation in the powder particles during the impact process. However, this factor is alone is insufficient to achieve metallurgical bonding of the powder particles during impact. Only through plastic deformation will solid-state powder particles deform to the extent required to fracture the oxide surface and expose metallurgical bonding surfaces. The degree of plastic deformation of the powder particles and substrate during impact is a function of the temperature, strain rate, and strain. Thus, by heating the powder particles and substrate, the amount of plastic deformation during impact can be favorably increased to improve deposition efficiency and control the physical state of consolidation. This process is called thermal-plastic conditioning. The temperature dependence of the yield strength and the influence on the plastic deformation properties for many materials can be obtained from references such as Dieter, G. E., 1961, Mechanical Metallurgy FIGS. 9–12 and 9–13). Other changes in the mechanical properties of materials (particularly metals) induced by heating include a decrease in hardness, and a reduction in strength with an increase in ductility. For most face-center cubic materials these changes are monotonically dependent on the temperature of the material with no particular threshold. Some body-centered materials, such as tungsten, exhibit a brittle-to-ductile transition knee with temperature (REF: Dieter, G. E., 1961, Mechanical Metallurgy FIGS. 9–12 and 9–13).

Heating the entrained powder particles reduces the modulus of rigidity and decreases the yield strength of the particles, which in turn enhances plastic deformation during impact at low flow stress levels. This increases deposition efficiency for high-velocity particle impacts using thermal-plastic conditioned powder particles. For example, heating 20-micometer aluminum powder to a temperature of 400 Kelvin permits deposition efficiencies in excess of 60% using the applicator and process disclosed in this invention. This compares to deposition efficiencies of less than 15% for 300 Kelvin aluminum powder particles. Thus, a temperature differential of only 100 Kelvin is very significant in terms of reducing the yield strength of aluminum and enhancing plastic deformation.

The friction-compensated sonic nozzle in this invention is designed and constructed to flow the carrier gas at constant velocity of Mach 1 or less with compensation for the flow friction characteristic of the carrier gas and entrained powder particles. This requires a tapered nozzle with a constrained diameter variation as a function of length that compensates for frictional loss to maintain a constant velocity of Mach 1 or less for the carrier gas. The tapered nozzle design uniquely constrains the expansion of the carrier gas to maintain maximum carrier gas density (relative to the inlet gas density) as a function of the taper outlet length only for constant velocity flows of Mach 1 or less. Thus the particular design of the tapered friction-compensated sonic nozzle ensures maximum drag and acceleration of the powder particles over the entire length of nozzle.

The thermal-transfer plasma in the basic embodiment is generated at ambient pressure (atmospheric pressure) and thus forms a thermal plasma in equilibrium with the electron temperature (Elenbass, E., 1951. The High Pressure Mercury Vapor Discharge, Amsterdam, The Netherlands: North Holland). Simultaneously coupling the kinetic energy of the particles transferred to the impact process with the reduction in the yield strength, induced by thermal-plastic conditioning or heating, permit plastic deformation that results in adherence to the substrate and cohesive consolidation of the powder particles with unique properties.

This yields depositions with unique microstructure properties and permits coating spray forming, joining, or fusing of various materials. In addition, the thermal-transfer plasma of the invention provides the means to chemically react the entrained powder particles and the substrate at the deposition region by adding chemical reactive species to the plasma gas. U.S. Pat. No. 5,691,772 issued to Selwyn teaches the efficacy of using radical and metastable reactants entrained in an atmospheric plasma gas jet to etch films and coatings on a substrate.

The apparatus and process of the invention uses a thermal-transfer plasma established between the exit of a friction-compensated sonic nozzle and the substrate work piece for heating the powder particles, heating the substrate materials, and chemically reacting the powder particles and substrate materials.

In one configuration a Radio Frequency (RF) generator capable of producing RF power is coupled through a matching network to produce thermal-transfer plasma (capacitively coupled) between the outlet of the nozzle and the substrate. In another configuration, the RF power is coupled through a matching network to a coaxial induction coil surrounding the cylindrical nozzle. The inductively coupled thermal plasma at the exit of the nozzle is transferred to the substrate via a bias voltage applied between the nozzle metallic tip and the substrate. In both configurations the nozzle is generally the cathode electrode, while the substrate is the anode electrode to ensure electron flow toward the substrate work piece, however the invention also includes the use of reverse polarity for applications that require ion flow toward the substrate. The reverse polarity connection permits variations of the invention that uses electron flow into a sacrificial nozzle to atomized material from the tip of the nozzle within an inert gas shield that is co-deposited with the powder particles entrained in the carrier gas. This reverse polarity connection is used to produce low porosity, fine grain coatings or to tailor the specific material properties of coatings, spray formed materials, or joints.

Various gases can be used with the present invention and are selected from a group comprising air, argon, carbon tetrafluoride, carbonyl fluoride, helium, hydrogen, methane, nitrogen, oxygen, steam, silane, sulfur hexaflouride, or mixtures thereof in various concentrations. Helium gas is frequently used for producing atmospheric plasmas (e.g., U.S. Pat. No. 5,961,772 and Laroussi, M., June 1196, "Sterilization of Contaminated Matter with an Atmospheric Pressure Plasma" IEEE Trans. on Plasma Science, Vol. 24, No. 3, pp-1188–1191) to limit ionization, which leads to arcs, and is a preferred gas for accelerating powder particles in the friction-compensated sonic nozzle. The entrained powder particles flow out the exit of the nozzle and pass through the thermal-transfer plasma, which heats the powder particles prior to impact on the substrate. The temperature of the particles depends on the particle size, material, dwell time in the thermal plasma and the total power dissipated in the plasma. Typically, for aluminum alloy powders in the 1–20 micrometer diameter range, the particles reach a temperature of 400 degrees Kelvin that yields deposition efficiency in excess of 60%. For aluminum alloy powders this requires a RF plasma power of 1–3 kilowatts for helium flow rates of 10–30 SCFM. Mixtures of gases that form reactive radical and metastable species in the thermal plasma are included in the invention for the purpose of chemically reacting the powder particles during transit.

The thermal-transfer plasma is also effective in heating the substrate for spray forming, joining or fusing of various materials. In these cases the localized temperature of the substrate is increased by the inherent focusing of the thermal-transfer plasma beam to the deposition profile on the substrate, and is used to thermally alter or melt the substrate including coherent powder particles previously deposited on the substrate surface or joint. In addition, the thermal-transfer plasma provides the means for treatment of the substrate including either mechanical ablation or abrasion of oxide films followed by chemical reaction including etching.

A complementary embodiment of this invention uses a powder reactor to alter the physical, chemical, or nuclear properties of powder particles prior to injection into a friction-compensated sonic nozzle for acceleration. Various configurations of the powder reactor are disclosed for physically altering the properties of the powder particles entrained in the carrier gas by heating the gas and powder particles with conventional resistive heaters or induction heaters. Other configurations of the powder reactor are used for chemically altering the powder particles entrained in the carrier gas or modifying the nuclear properties for spraying radioactive or other isotopic species of powder particles. A powder reactor configuration using a high-pressure plasma reaction chamber for heating or ionizing a mixture of carrier gas and powder particles is included with the invention. Admixtures of chemicals may also be added to the carrier gas for the purpose of chemically reacting the powder particles or substrate using various radical species produced in the plasma. The powder particles are injected downstream into the plasma-heated gas to heat said particles prior to acceleration in the friction-compensated sonic nozzle. This invention also embodies the use of the powder reactor including the high-pressure plasma reaction chamber to alter the physical, chemical, or nuclear properties of powder particles prior to injection into supersonic nozzles for acceleration of powder particles such as that disclosed in U.S. Pat.

Nos. 5,795,626 and 6,074,135 issued to the present inventors, and prior to injection into a supersonic jet such as that disclosed in U.S. Pat. No. 5,302,414B1, RU Patent 1773072 issued to Alkhimov et al., and U.S. Pat. No. 6,139,913 issued to Van Steenkiste et al.

The applicator uses an outer evacuator chamber and optionally an outer coaxial evacuator nozzle (as described in U.S. Pat. Nos. 5,795,626 and 6,074,135 issued to the present inventors for application with supersonic jets and nozzles), surrounding the friction-compensated sonic nozzle. These evacuators are used for reducing the entrainment of air and unwanted gases into the directed subsonic or sonic jet of inert carrier gas, while permitting capture of excess powder particles and debris in a conventional dust collector filter. The outer evacuator chamber and optional outer coaxial evacuator nozzle also permits the nozzle gases to be captured and recycled for environmental and economic purposes.

A powder-fluidizing unit for fluidizing and entraining the powder particles within the carrier gas is included in the invention. The powder-fluidizing unit has been specified in U.S. Pat. No. 6,074,135 issued to Tapphorn and Gabel for supersonic jets and nozzles and is included in this invention by reference. In addition, the invention includes improvements to the powder fluidizing technique.

One improvement includes a fluidizing port mounted on the end of an extendable tube that can be incrementally and continuously injected into the top surface of the powder for fluidizing powder particles above the level of the bulk powder contained in the hopper. A second improvement includes measurement of the powder loss using an electronic or optical load cell or real time measurement of powder flow rates to control the powder fluidizing rate at a preset valve using electronic or software processing control (e.g., Proportional Integral Derivative (PID) controllers).

The present invention comprises a process for depositing multi-layer coatings, functionally graded materials, and functionally formed in-situ and ex-situ composites on a substrate. For example, the first layer of multi-layer coating used in aluminum brazing typically consists of an undercoat layer that is used as a corrosion protection barrier between the eutectic layer and the substrate alloy. The first layer may also be employed as a diffusion barrier or adhesion interface between the substrate structure and the subsequent layers. The second layer of the multi-layer braze coating serves as a eutectic solder or braze filler with a melting point that is 5 to 50 degrees Kelvin below the melting point of the structural base material. Aluminum-silicon alloys are frequently used as eutectic fillers for brazing aluminum alloys, and this invention permits the deposition of these fillers as metallic powders under conditions that preclude metallurgical, chemical or mechanical alterations of the substrate material during deposition. The third layer of the multi-layer braze coating is deposited as a flux to displace the oxide from the surface of the substrate, lower the filler metal's surface tension, and promote base metal wetting and filler metal flow. The flux coating may consist of a nonmetallic flux powder such as a potassium fluoro-aluminate salt or a metallic flux powder such as nickel, cobalt or nickel/lead based alloy that is also applied under conditions that that preclude metallurgical, chemical or mechanical alterations of the substrate material during deposition. Finally, a method of simultaneously co-depositing metallic and nonmetallic powders for the purpose of applying composite brazes with embedded flux are also embodied within this invention.

The present invention discloses a method that enables controlled temperature deposition of multi-layer coatings comprising undercoats, braze-filler, and flux layers as powders using the applicator described above. Undercoat powders comprise powders selected from a group of aluminum, copper, titanium, or zinc metallic powders while the braze-filler powders are selected from a group of aluminum-silicon alloys (e.g., 4043, 4045, 4047 alloys). Aluminum alloys that can be brazed are typically wrought alloys of 1100, 3003, 5050, 6061 and cast alloys of 443.0, 356.0, 711.0.

Methods for depositing nonmetallic powders selected from a group comprising polymers, ceramics, or glasses using the apparatus and process of this invention are also disclosed. In particular powders of high-density polyethylene or polytetrafluoroeythylene (Teflon™) can be applied with the plasma power selected to raise the temperature of the powder particles to the glass transition temperature of the specific polymer. Although not intended to accommodate the high temperature depositions required for melting ceramic and glass powders, these materials can be co-deposited as an ex-situ strengthening agent (powder form) in metallic or nonmetallic matrix materials.

The technical advantage of using the process described in this invention over existing spray coating technologies (e.g., gas thermal spray, plasma arc-spray, wire-arc spray, and high velocity oxygen-fuel spray) is that it produces low-porosity metal depositions with no surface pretreatment, excellent adhesion, no significant in-situ oxidation, and no coating-process induced thermal distortion of the substrate. By accelerating the powder particles through a friction-compensated sonic nozzle optimized for imparting high velocities to the particles, in combination with the thermal-transfer plasma or powder reactor heating source the deposition conditions and material properties (plastic deformations) can be uniquely tailored for a particular application. For example, deposition of aluminum coatings only requires heating (thermal-plastic conditioning) the powder particles to a temperature of 400 K to achieve 60% deposition efficiencies for particles in the 10–20 micrometer range at the high velocities provided by the friction-compensated sonic nozzle. This temperature is also adequate to permit simultaneous low temperature annealing of the deposited or spray formed material, thus enabling the properties of the deposited material to be controlled or tailored to specific requirements. Particle and substrate surface cleaning and etching occurs continually and in-situ with the metal deposition so no other surface pretreatment is required.

Finally, the apparatus and process of this invention permits co-deposition of powders to functionally form in-situ and ex-situ composites. In one example, a metallic powder (e.g., aluminum) is co-deposited with an ex-situ strengthening agent selected from a group comprising silicon, carbide, boron carbide, alumina, tungsten carbide, or mixtures thereof to form a particle reinforced metal matrix composite that has homogeneous dispersion of the strengthening agent. In another example the invention permits the co-deposition of metallic powders into a consolidated composite that is subsequently transformed (final heat treatment) into an in-situ particle reinforced metal matrix composite after finish machining.

A variation of this example permits the co-deposited of metallic powders with other metallic or nonmetallic powder mixtures to tailor coatings or spray formed materials with unique properties. For instance, by co-depositing mixtures of aluminum and chromium powders (equal parts by weight), an electrically conductive strip can be applied to steel that has a tailored electrical resistivity (i.e., typically 72 $\mu\Omega$-cm), excellent corrosion resistance (20 years in salt water immersion at 70° F.) and an excellent adhesion strength on steel.

The invention also includes consolidation of functionally graded materials in which the properties of the deposition (e.g. thermal expansion, thermal conductivity, strength, ductility, corrosion resistance, color, etc.) are functionally graded in discrete or step-wise layers as well as continuously graded. Continuous grading of functionally graded materials is accomplished by co-depositing powder mixtures in which the concentration of each powder is varied as a function of coating thickness.

A combination of functionally formed and functionally graded materials is included in the invention. An example of this embodiment includes encapsulation of an inner core of material (e.g. metallic alloy, metallic foam, ceramic or composite) with a monolithic layer, functionally graded layer of materials, functionally formed in-situ composite or functionally formed ex-situ composites to tailor specific properties of the finished part or component.

The invention also includes the consolidation of porous coatings or spray formed materials by controlling the particle-size distribution of the powder during the deposition process. Large powder particles (>325 mesh) consolidated without an admixture of fine or ultra-fine particles (<325 mesh) produces materials with high porosities. These types of consolidations provide the means for producing porous structures for catalytic reactors, filters, and matrices for encapsulating or sealing admixtures of other metallic and nonmetallic materials.

For example, a porous matrix of titanium powder deposited as a coating on a substrate surface can be sealed with epoxy for providing an excellent corrosion resistant coating on reactive metal surfaces. In another example, pyrophoric materials can be injected into a metallic matrix for controlling the pyrophoric reactivity, temperature, and spectral emission of a pyrophoric flare. In still other examples, reactive metallic or nonmetallic materials (e.g., oxygen or water) can be injected into the pores of the metal matrix consolidation (e.g., aluminum, boron, titanium or mixtures thereof to create an explosive or detonable mixture when heated to a threshold temperature by a pyrophoric thermite material.

In addition to the just described benefits, other advantages of the present invention will become apparent from the detailed description which follows hereinafter when taken in conjunction with the drawing figures which accompany it.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

Figure 1:
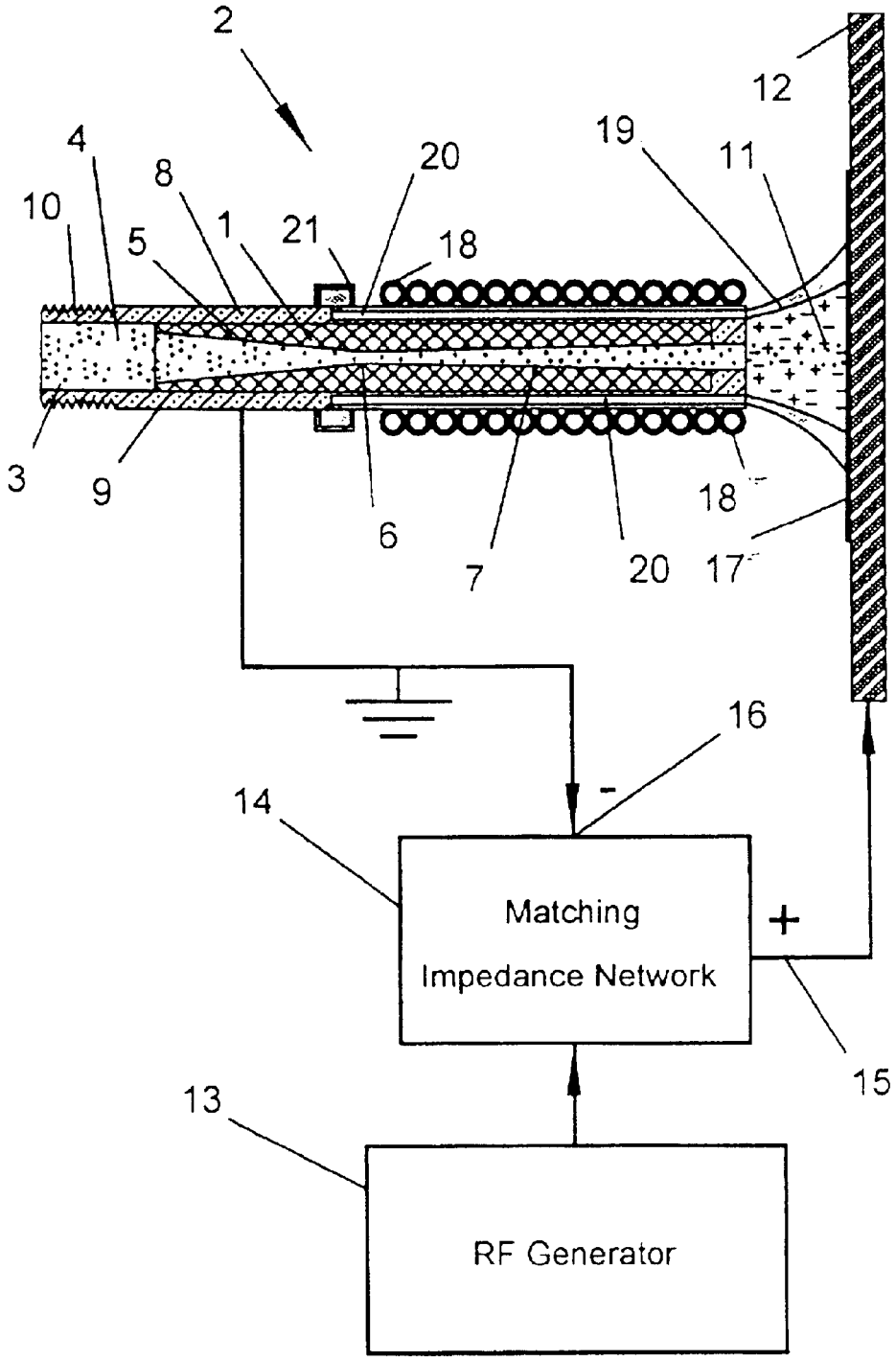
FIG. 1 is a combined block diagram and cross-section view of the friction-compensated sonic nozzle liner showing a diffuse thermal-transfer plasma established between nozzle outlet and substrate used to thermally alter powder particles prior to impact on the substrate.

In the following description of the preferred embodiments of the present invention, reference is made to the accompanying drawings which form a part hereof, and in which is shown by way of illustration specific embodiments in which the invention may be practiced. It is understood that other embodiments may be utilized and structural changes may be made without departing from the scope of the present invention.

In general the present invention relates to an apparatus and process for solid-state deposition and consolidation of powder particles entrained in a subsonic or sonic gas jet onto the surface of an object. Under high velocity impact and thermal plastic deformation, the powder particles adhesively bond to the substrate and cohesively bond together to form consolidated materials with metallurgical bonds. The powder particles and optionally the surface of the object are heated to a temperature that reduces yield strength and permits plastic deformation at low flow stress levels during high velocity impact, but which is not so high as to melt the powder particles. This process is call thermal-plastic conditioning. Simultaneously coupling the kinetic energy of the particles transferred to the impact process with the reduction in yield strength of said powder particles and substrate, induced by heating (thermal-plastic conditioning), permit solid-state deposition and consolidation of coatings, spray forming of parts, or joining of various materials via thermally dependent plastic deformation. By controlling the velocity of the impact process in combination with thermal-plastic conditioning the material properties can be tailored to specific requirements. For example, the severe plastic deformation induced by the impact process is responsible for the creation of nanostructures within the microstructure of the consolidated powder particles. Thermal plastic conditioning of the powder particles allows these nanostructures to be modified through enhanced dynamic recovery of dislocation densities. The basic embodiment of the invention uses a friction-compensated sonic nozzle to accelerate powder particles to high velocities with several methods for heating the powder particles and substrate. The invention reduces the degree of oxidation and chemical combustion of the powder particles by using a directed subsonic or sonic jet of inert carrier gas at relatively short standoff distances to the substrate to minimize entrainment of air or other unwanted gases into the deposited and consolidated material. One method of the thermal-plastic conditioning or heating the powder particles and substrate uses an ambient pressure thermal-transfer plasma between the nozzle exit and the substrate at relatively short standoff distances. A complementary embodiment of the invention uses a powder reactor to alter the physical, chemical, or nuclear properties of powder particles prior to injection into a friction-compensated sonic nozzle for acceleration. A preferred embodiment of the powder reactor uses a high-pressure plasma reaction chamber for heating or ionizing a mixture of carrier gas and powder particles. Admixtures of chemicals or chemical gases may also be added to the carrier gas for the purpose of chemically reacting the powder particles or substrate using various reactive chemical species produced both in the plasma and heated gases. The powder particles are injected downstream into the plasma-heated gas to heat said particles prior to acceleration in the friction-compensated sonic nozzle. The applicator also uses an outer evacuator chamber and an optional outer coaxial evacuator nozzle surrounding the friction-compensated sonic nozzle for retrieving excess powder particles and nozzle gases to be recycled for environmental and economic purposes. Finally, a powder fluidizing unit for fluidizing, entraining, and mixing the powder particles within the carrier gas is included as part of the applicator. Methods for reducing the invention to practice by co-depositing and consolidating powder particles with other metallic or nonmetallic powder mixtures to fabricate porous materials, multi-layer coatings, functionally graded materials, functionally formed in-situ or ex-situ composite materials are disclosed. The foregoing aspects of the present system and process will now be described in greater detail in the paragraphs to follow.

FIG. 1 shows the basic embodiment of the apparatus and process used in this invention. The liner 1 of the friction-compensated sonic nozzle 2 is used to accelerate powder particles 3 entrained in a directed jet of carrier gas 4. Methods for producing, entraining, and treating the powder particles 3 in carrier gas 4 have been disclosed in U.S. Pat. No. 6,074,135 issued to the present inventors. The types of powder particles 3 that can be entrained in the carrier gas 4 include, but are not limited to, powders consisting of metals, alloys, low temperature alloys, high temperature alloys, superalloys, braze fillers, metal matrix composites, nonmetals, ceramics, polymers, and mixtures thereof. Indium or tin-based solders and silicon based aluminum alloys (e.g., 4043, 4045, or 4047) are examples of low temperature alloys that can be deposited and consolidated in the solid-state for coatings, spray forming, and joining of various materials using the apparatus and process of this invention. High temperature alloys include, but are not limited to NF616 (9Cr-2W—Mo—V—Nb—N), SAVE25 (23Cr-18Ni—Nb—Cu—N), Thermie (25Cr-20Co-2Ti-2Nb—V—Al), and NF12 (11Cr-2.6W-2.5Co—V—Nb—N). Superalloys include nickel, iron-nickel, and cobalt-based alloys disclosed on page 16–5 of Metals Handbook, Desk Edition 1985, (American Society for Metals, Metals Park, Ohio 44073. Powder particles 3 coated with another metal such as nickel and cobalt coated tungsten powders are also included as a special type of composite powder that can be used with apparatus and process of the invention.

The preferred powder particle size for the apparatus and process of this invention is generally a board distribution with an upper limit of −325 mesh (<45 micrometers). However, powder particle sizes in excess of 45 micrometers can be used as strengthening agents for co-deposition with a matrix material for forming metal matrix composites. Powder particle sizes in the nanoscale range can also be deposited and consolidated with apparatus and process of this invention.

The carrier gas 4 is selected from a group including but not limited to air, argon, carbon tetrafluoride, carbonyl fluoride, helium, hydrogen, methane, nitrogen, oxygen, silane, steam, sulfur hexaflouride, or mixtures thereof in various concentrations. Helium gas is a preferred inert carrier gas 4 for accelerating powder particles 3 to high velocities within the nozzle liner 1 because of its density, high velocity of sound, and dielectric breakdown characteristics used to generate plasma. In addition, helium permits the carrier gas 4 and powder particles 3 to be thermally conditioned at elevated temperatures without oxidizing or chemically reacting the powder particles. Admixtures of argon in helium carrier gas 4 permit enhanced acceleration of powder particles in the friction-compensated sonic nozzle 2, while retaining an inert gaseous environment. Specific carrier gas 4 mixtures using helium, hydrogen, argon and nitrogen can be additionally tailored to provide a carrier gas 4 mixture with a high sonic velocity equivalent to the sonic velocity of pure helium gas while optimizing the carrier gas 4 density for maximum acceleration of powder particles in the friction-compensated sonic nozzle 2. Admixtures of other reactive gases in helium carrier gas 4 such as hydrogen can be used to chemically react with the powder particles 3 to remove oxide layers on the powder particles 3. Chemical and physical treatment of powder particles 3 entrained in carrier gas 4 can further be implemented by admixtures of various reactive gases in various concentrations selected from a group including but not limited to air, hydrogen, carbon tetrafluoride, carbonyl fluoride, methane, nitrogen, oxygen, steam, silane, sulfur hexaflouride, or mixtures thereof.

The liner 1 of the friction-compensated sonic nozzle 2 is designed to accelerate powder particles 3 entrained in a carrier gas 4 by using an axisymmetric converging inlet 5 that has a length-to-throat 6 diameter ratio of at least 10:1. Preferably, the axisymmetric converging inlet 5 has a length-to-throat 6 diameter ratio of approximately 40:1. The axisymmetric tapered outlet 7 following the throat 6 constrains the carrier gas 4 flow to constant velocity (≦Mach 1) because of the flow friction associated with the carrier gas 4 and entrained powder particles 3. The tapered outlet 7 contour is prescribed in accordance with the well-known relationship for diameter variation as a function of length for constant velocity flow with friction (John, J. E. A., 1984 Edition, Gas Dynamics, Allyn and Bacon, Inc. Boston, Mass., p. 196, equation 9.36).

Equation (1) gives the general relationship for adiabatic flow with friction where f is the coefficient of flow friction, γ is ratio of specific heat capacities for the carrier gas 4 and powder particle 3 mixture, M is the Mach number for the flow, and A is the area of the axisymmetric tapered outlet 7 section as a function of length x. For the case of constant velocity flow the derivative of the second term is zero, which yields the diameter variation (D) of the axisymmetric tapered outlet 7 as a function of length (see Equation (2)) for a circular cross-section. Concurrently, the axisymmetric tapered outlet 7 contour prescribed by Equation (2) also uniquely maximizes the gas density in the axisymmetric tapered outlet 7 section as given by Equation (3) (for isentropic and adiabatic flow), but only for subsonic or sonic flow where ρt is gas density at the axisymmetric converging inlet 5. Thus, the maximum gas density convoluted with the sonic velocity of the gas yields the greatest drag force on the powder particles 3 to achieve the highest acceleration of the powder particle 3 to velocities up to the sonic velocity of the carrier gas 4. Note corrections to Equations (1)–(3) are required to explicitly account for non-adiabatic flow theory with friction as given by equation 10.32 in John, J. E. A., 1984 Edition, Gas Dynamics, Allyn and Bacon, Inc. Boston, Mass., p. 222.

$$\frac{1}{2}\cdot\gamma\cdot M^2\cdot\frac{f}{D}=\frac{1}{A}\cdot\frac{dA}{dx}+\frac{dM}{dx}\cdot\frac{(1-M^2)}{\left[1+\frac{(\gamma-1)}{2}\cdot M^2\right]} \tag{1}$$

$$\frac{1}{4}\cdot\gamma\cdot M^2\cdot f=\frac{dD}{dx} \tag{2}$$

$$\rho=\frac{\rho_t}{\left[1+\frac{(\gamma-1)}{2}\cdot M^2\right]^{((\gamma+1)/(4-4\gamma))}} \tag{3}$$

The length-to-throat 6 diameter ratio (Equation (2) calculation for helium) is specified to be 48:1 for the axisymmetric tapered outlet 7 section with a media flow friction of 0.05 using helium gas at a constant flow velocity equal to Mach 1.

For media flow friction as high as 0.15, the length-to-throat 6 diameter ratio of the axisymmetric tapered outlet 7 section would reduce to 15:1 for helium gas at a constant flow velocity equal to Mach 1. The diameter variation specified above uniquely maintains the carrier gas 4 density relative to the inlet gas density at a maximum value along the entire length of the axisymmetric tapered outlet 7 section as describe by Equation (3) with M≦1.0 for isentropic flow after correcting for nonadiabatic conditions with flow friction. That is for diameter variations of the axisymmetric tapered outlet 7 section in excess of that specified by the relationship given above (Equation (2)), the carrier gas 4 density (i.e., relative to the inlet gas density) will decrease as prescribed by Equation (3) as the expansion condition permits the gas to proceed to exceed sonic velocities. On the other hand, for diameter variations of the axisymmetric tapered outlet 7 section less than that specified by the relationship given above (Equation (2)), the media flow friction will continue to decrease the carrier gas 4 velocities to the subsonic regime with a corresponding decrease in particle velocity. Thus, for the diameter variation condition specified above (Equation (2)) for the axisymmetric tapered outlet 7 section and in accordance with the length-to-throat 6 diameter ratio limits specified above, the carrier gas 4 density (relative to inlet gas density) is maximized in both the axisymmetric converging inlet 5 and the axisymmetric tapered outlet 7 sections. In the axisymmetric converging inlet 5 section the carrier gas density 4 (relative to inlet gas density) is predicted by applying isentropic flow theory (Equation 3) and compensating for flow friction and non-adiabatic flow theory. In the axisymmetric tapered outlet 7 section, the carrier gas density 4 (relative to inlet gas density) is maintained at a maximum value (after correcting for flow friction effects and non-adiabatic flow) along the length of the nozzle. This condition convoluted with the constant sonic velocity of Mach 1 maintained in the axisymmetric tapered outlet 7 section uniquely provides the maximum drag force to accelerate the powder particles 3 over the entire length of the friction-compensated sonic nozzle 2.

The friction-compensated sonic nozzle 2 confines the powder particles 3 and carrier gas 4 mixture that flows out of the tapered outlet section 7 to a narrow cross sectional area jet to reduce influx of unwanted gas into the carrier gas 4 stream and deposition region. In addition, the carrier gas 4 exits the friction-compensated sonic nozzle 2 at slightly less than sonic velocities to maintain a subsonic nonexpanding jet between the exit of the friction-compensated sonic nozzle 2 and the substrate 12 for a large range of friction-compensated sonic nozzle 2 to substrate 12 standoff distances.

Conventional long-venturi nozzles used in the grit and sand blasting industries to abrade and clean surfaces at high gas pressures are not friction compensated for the powder particles 3 entrained in the carrier gas 4 used in the apparatus and process of this invention. These nozzles typically induce supersonic flow of compressed air and have throat diameters in excess of 5-mm.

In addition, these nozzles have length-to throat diameter ratios less than 10:1 for the converging section and 12:1 for the diverging outlet of a circular cross-section nozzle. As such, the design of these supersonic nozzles preclude maximum acceleration of the powder particles 3 to high impact velocities within the carrier gases 4 identified in the apparatus and process of this invention.

The cross-section view of the friction-compensated sonic nozzle 2 and more importantly, the liner 1 shown in FIG. 1 has cylindrical symmetry about the nozzle axis, other liner 1 contours which constrain the flow to a constant velocity with friction of Mach 1 or less are included. For example, elliptically contoured (cross-section) tapered outlet 7 is also included in the apparatus of this invention.

Figure 2:
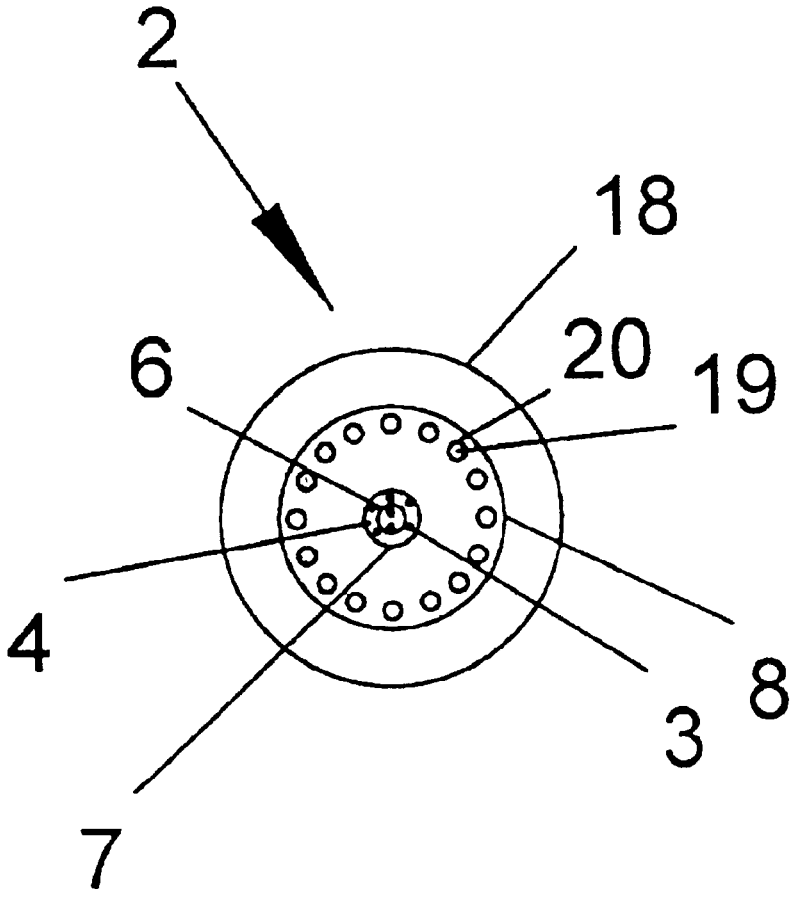
FIG. 2 shows an enlarged plan exit view of the friction-compensated sonic nozzle outlet to illustrate the cylindrical symmetry.
Figure 3:
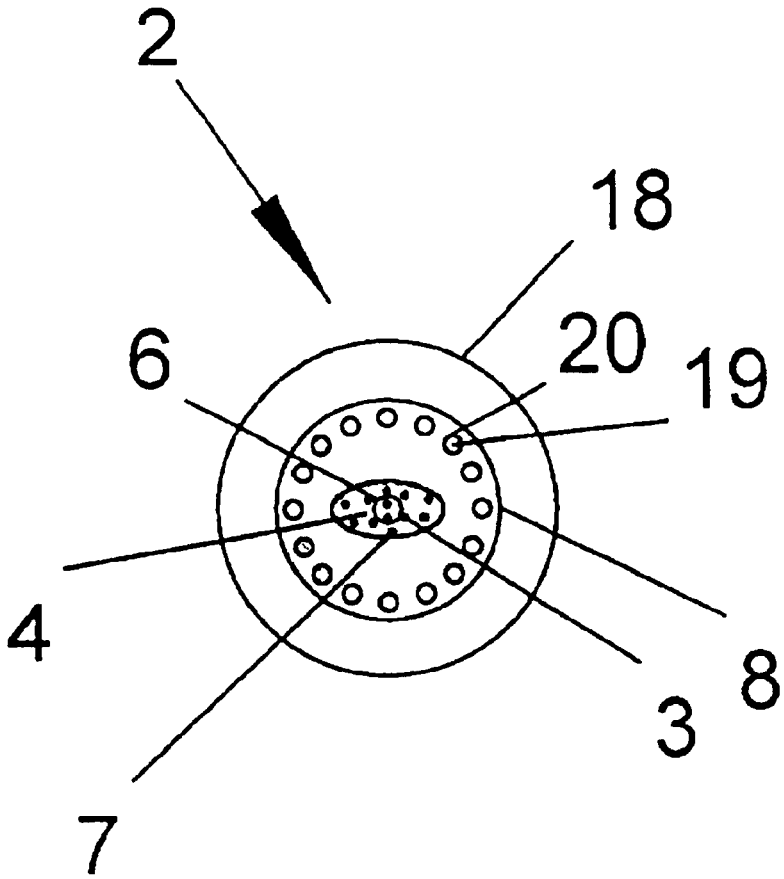
FIG. 3 is an alternative configuration of FIG. 2 is an enlarged plan exit view of the friction-compensated sonic nozzle showing elliptical cross-section for the outlet of the nozzle.

Effective constraint conditions generally prescribe by Equations 1 through 3 are still required for friction compensated flow, but the complex geometry of non-circular cross sections requires three-dimension solutions. Again corrections for non-adiabatic 3-D flow theory are required to obtain exact solutions for elliptically contoured (cross-section) tapered outlet 7. FIG. 2 shows a plan exit view of the friction-compensated sonic nozzle 2 to illuminate the cylindrical symmetry. In contrast, FIG. 3 shows the tapered outlet 7 with an elliptical contoured cross-section for the friction-compensated sonic nozzle 2.

The liner 1 is fabricated from materials of construction selected from a group comprising metals, alloys, ceramics, nonmetallics, or mixtures thereof and machined to a surface finish with a specified flow friction value for the combined carrier gas 4 and entrained powder particle 3 mixture. The liner 1 is installed or bonded within nozzle housing 8 to prevent carrier gas 4 leakage through the bonding interface 9. The nozzle housing 8 has appropriate threads 10 or fittings for mating via a high-pressure hose to a high-pressure powder feeder such as the powder fluidizing units disclosed in U.S. Pat. No. 6,074,135 issued to Tapphorn and Gabel.

Effluent output from the friction-compensated sonic nozzle 2 comprising carrier gas 4 and powder particles 3 is injected into the thermal-transfer plasma 11 established between the exit of friction-compensated sonic nozzle 2 and the substrate 12 at relatively short standoff distances. Helium gas is frequently used for producing atmospheric plasmas (e.g., U.S. Pat. No. 5,961,772 and Laroussi, M., June 1196, "Sterilization of Contaminated Matter with an Atmospheric Pressure Plasma" IEEE Trans. on Plasma Science, Vol. 24, No. 3, pp-1188–1191) to limit ionization leading to arcs and is the preferred carrier gas 4 for this invention. Admixtures of oxygen or other gases in helium are frequently used to produce chemical radicals and metastable species within atmospheric plasmas (e.g., U.S. Pat. No. 5,961,772) for reactive ion etching of surfaces. This invention includes the addition of admixtures of chemicals to the carrier gas 4 to chemically react the powder particle 3 and substrate 12 material during deposition.

The types of substrate 12 materials that can be that can be coated or used for deposition and consolidation surfaces with apparatus and process of the invention are selected from a group but are not limited to materials consisting of metals, alloys, low temperature alloys, high temperature alloys, superalloys, metal matrix composites, nonmetals, ceramics, polymers, and mixtures thereof.

The thermal-transfer plasma 11 is generated using a conventional RF generator 13 coupled through a matching impedance network 14 such that the substrate 12 is at the RF anode potential 15 and the nozzle is at the RF cathode potential 16. This arrangement permits electron flow toward the substrate 12 that is additionally used to attract the thermal-transfer plasma 11 to the substrate 12 for heating, etching, and cleaning of the substrate 12. A reverse polarity connection (not explicitly shown in FIG. 1) is also provided with the friction-compensated sonic nozzle 2 connected to the RF anode potential 15 and the substrate 12 connected to the RF cathode potential 16. The power level of the RF generator 13 is adjusted to heat the powder particles 3 during their transit time through the thermal-transfer plasma 11.

Simultaneously coupling the kinetic energy of the powder particles 3 transferred to the impact process with the reduction in yield strength of said powder particles 3 and substrate 12, induced by heating (thermal-plastic conditioning), permit solid-state deposition and consolidation of coatings of various materials via thermally dependent plastic deformation. This process yields high quality coatings 17 with low porosity, low oxidation, and minimal thermal distortion. Reduction of oxidation and chemical combustion of the powder particles 3 is achieved because the process reduces mixing and entrainment of air and unwanted gases into the directed jet of inert gas prior to deposition or consolidation on the substrate 12 at relatively short standoff distances. The process also yields depositions and consolidations with unique nanostructure and microstructure and permits spray forming, joining, and fusing of various materials. The coating 17 is sprayed over a large area of the substrate 12 by translating the friction-compensated sonic nozzle 2 in raster fashion over the substrate 12 at speeds that permit depositions to a specified thickness.

Cooling of the liner 1 occurs with high flow rates of carrier gas 4 through the friction-compensated sonic nozzle 2. Additional cooling of the nozzle housing 8 is provided, if necessary, by flowing water or other coolants through the cooling coil 18. Finally, an inert gas shield 19 is provided by injecting an inert gas through a plurality of conduits 20 circumferentially distributed in the wall of nozzle housing 8. The inert gas shield 19 is used to reduce influx of air or other unwanted contamination gases into the plasma, which can oxidize, or otherwise chemically interact with, the coating 17 or disrupt the plasma. The plurality of conduits 20 can be simultaneously fed from one source of inert gas by using the circumferential manifold 21 surrounding the nozzle housing 8.

Figure 4:
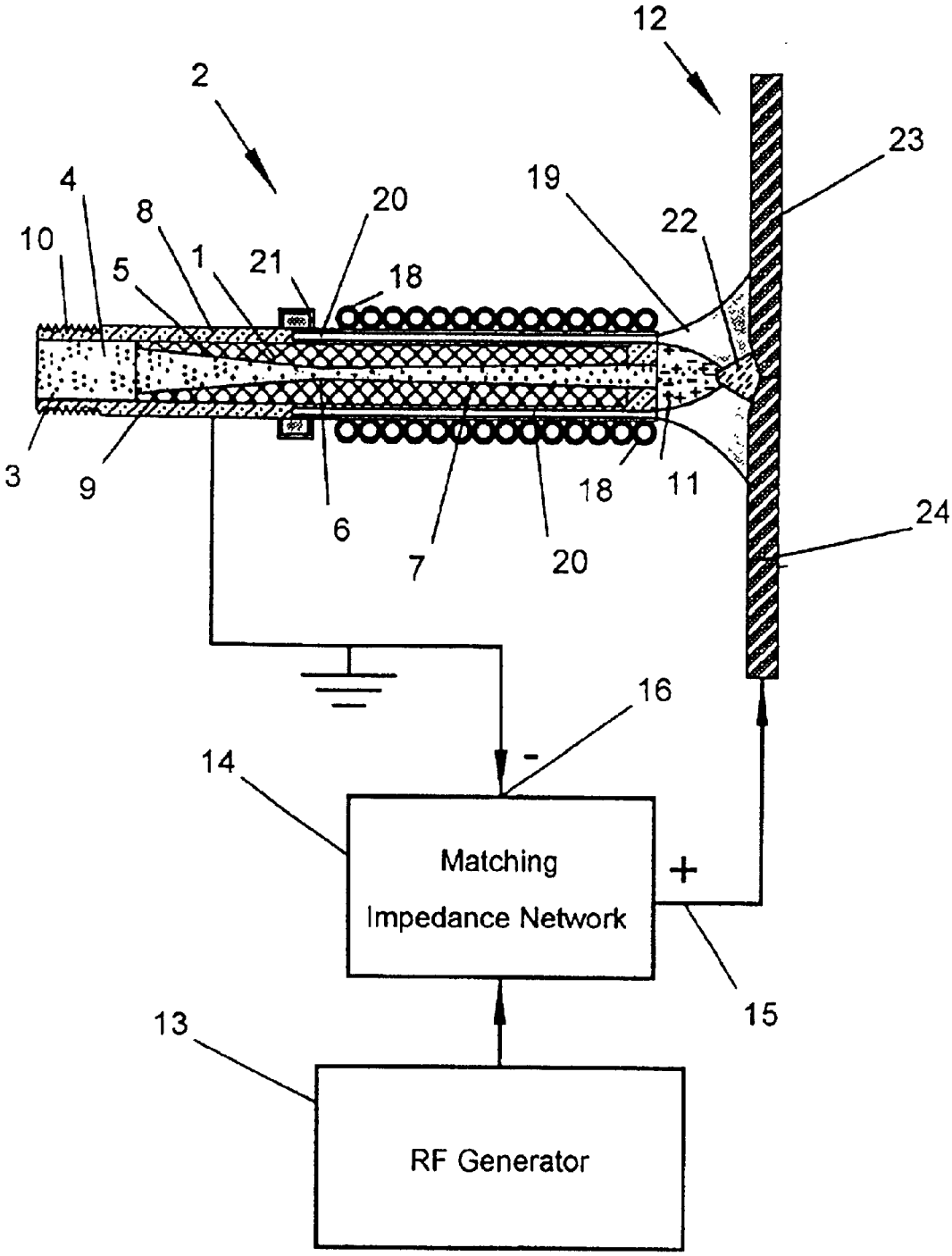
FIG. 4 is a combined block diagram and cross-section view of the friction-compensated sonic nozzle liner showing a focused thermal-transfer plasma formed between nozzle outlet and raised fillet on substrate used to thermally alter powder particles prior to impact on the substrate and to thermally alter or melt substrate materials including fillet.

FIG. 4 shows the friction-compensated sonic nozzle 2 used for the applications of spray forming, joining, or fusing of materials using powder particles 3 directed through the focused thermal-transfer plasma 11 established between the friction-compensated sonic nozzle 2 and the substrate 12 using RF generator 13 and matching impedance network 14. In the spray forming, joining, or fusing process, the deposition builds a raised fillet 22 as shown in FIG. 4. The raised fillet 22 provides the means for focusing the thermal-transfer plasma 11 to the substrate 12 to further enhance the heating and melting of the previously deposited material. In this particular example, the substrate 12 is represented as two separate pieces 23 and 24 that are joined as a butt joint by spray forming a raised fillet 22. Thus, depending on the choice of powder particles 3, substrate 12 materials, and applied RF generator 13 power the apparatus and process of this invention can be used not only for spray forming materials, but also joining similar or dissimilar materials by fusing materials.

Figure 5:
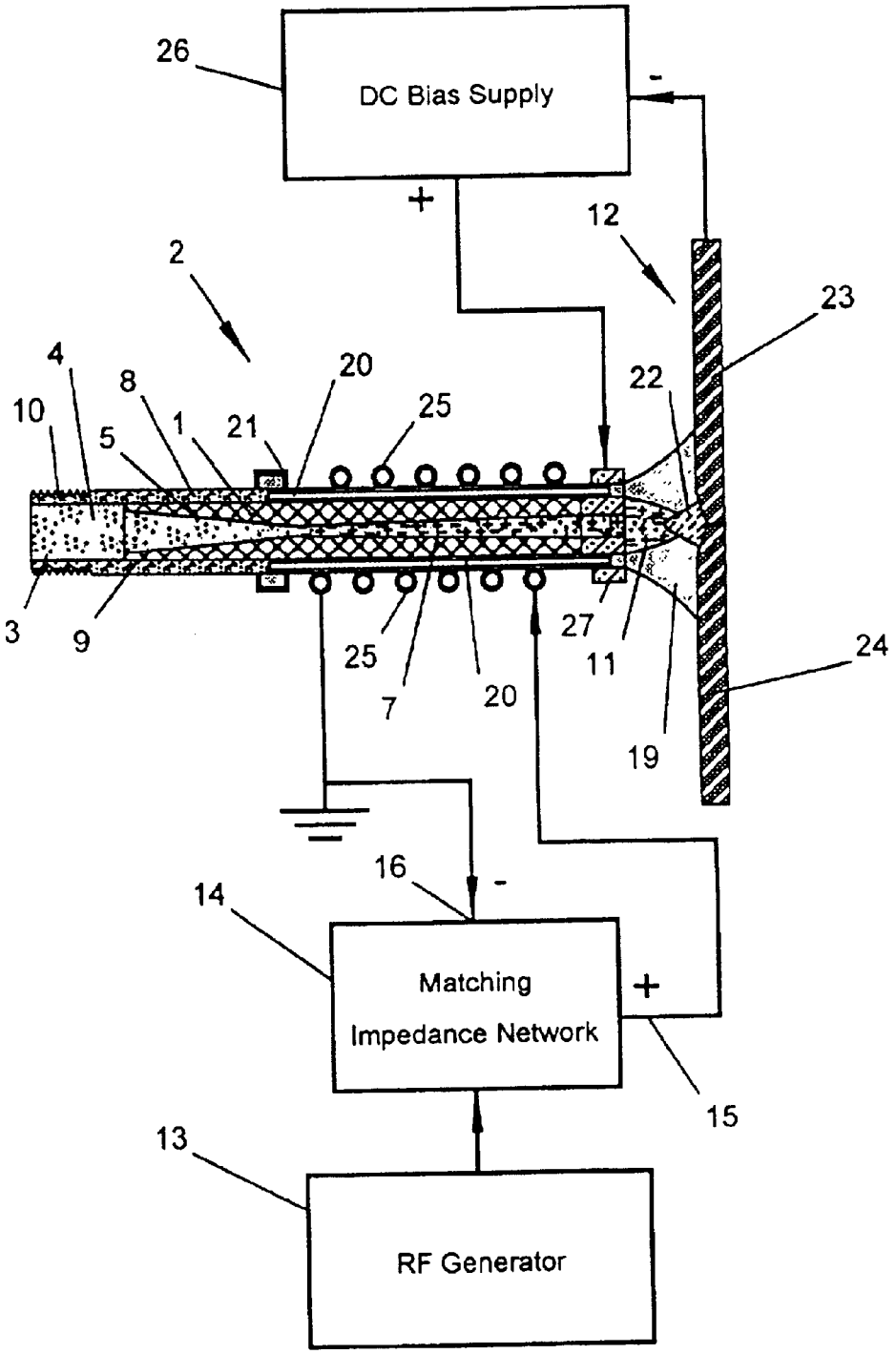
FIG. 5 is a combined block diagram and cross-section view of the friction-compensated sonic nozzle liner showing a focused thermal-transfer plasma generated by a concentric RF induction coil surrounding nozzle housing used to thermally alter powder particles prior to impact on the substrate and to thermally alter or melt substrate materials including fillet.

FIG. 5 shows a modification of the basic embodiment of the invention that includes an RF induction coil 25 surrounding the nozzle housing 8 to generate a thermal-transfer plasma 11 within the axisymmetric tapered outlet 7 of the liner 1. In this configuration, the materials of construction for the nozzle housing 8 and liner 1 have high electrical resistivity to isolate the RF induction coil 25 and to permit penetration of the RF field into the cavity of the axisymmetric tapered outlet 7. The RF induction coil 25 is constructed from brass or copper materials to provide high conductivity for the radio frequency power. Water or other fluids flowing through the RF induction coil 25 is used to cool the coils and the nozzle housing 8. The RF generator 13 is connected via the impedance matching network 14 to the RF induction coil 25 with the ground return to the cathode potential 16 terminal of the impedance matching network 14. The thermal-transfer plasma 11 is attracted to the substrate 12 for this configuration by employing a DC bias supply 26 connected between the substrate 12 and the metallic tip 27 of the nozzle housing 8 exit. The configuration shown in FIG. 5 is used for spray forming, joining or fusing of materials using powder particles 3 that are thermal-plastic conditioned in the thermal-transfer plasma 11 established between the friction-compensated sonic nozzle 2 and the substrate 12. The raised fillet 22 provides the means for focusing the thermal-transfer plasma 11 to the substrate 12 for build up to further enhance the heating and melting of the previously deposited material. The diffuse thermal-transfer plasma 11 configuration shown in FIG. 1 for coating 17 applications is also included as an alternative configuration of the apparatus described in FIG. 5 wherein the DC bias supply 26 is used to attract the diffuse thermal-transfer plasma 11 to the substrate 12.

A sacrificial nozzle alternative of the friction-compensated sonic nozzle 2 is shown in FIG. 5. In this case, the metallic tip 27 is removable and used as sacrificial material that can be atomized with the electron flow of the thermal-transfer plasma 11 directed toward the metallic tip 27 using the DC bias supply 26. The RF power of the RF generator 13 is increased to permit further heating of the sacrificial metallic tip 27 within the inert gases provided by the carrier gas 4 and the inert gas shield 19. The atomized material from the sacrificial metallic tip 27 is incorporated into the effluent comprising the powder particles 3 and the carrier gas 4 and transferred to the substrate represented as two separate pieces 23 and 24 (FIG. 1 substrate 12) by the thermal-transfer plasma 11. Atomized material from the sacrificial metallic tip 27 is used to modify the physical and chemical properties of the coating 17 (FIG. 1) or spray formed raised fillet 22 materials.

The alternative sacrificial nozzle described in FIG. 5 can also be implemented by using the friction-compensated sonic nozzle 2 configuration described in FIG. 4 in combination with the sacrificial metallic tip 27. In this case, a reverse polarity of the matching impedance network 14 is used to connect the anode potential 15 to the nozzle housing 8 while the substrate represented as two separate pieces 23 and 24 is connected to the cathode potential 16.

Figure 6:
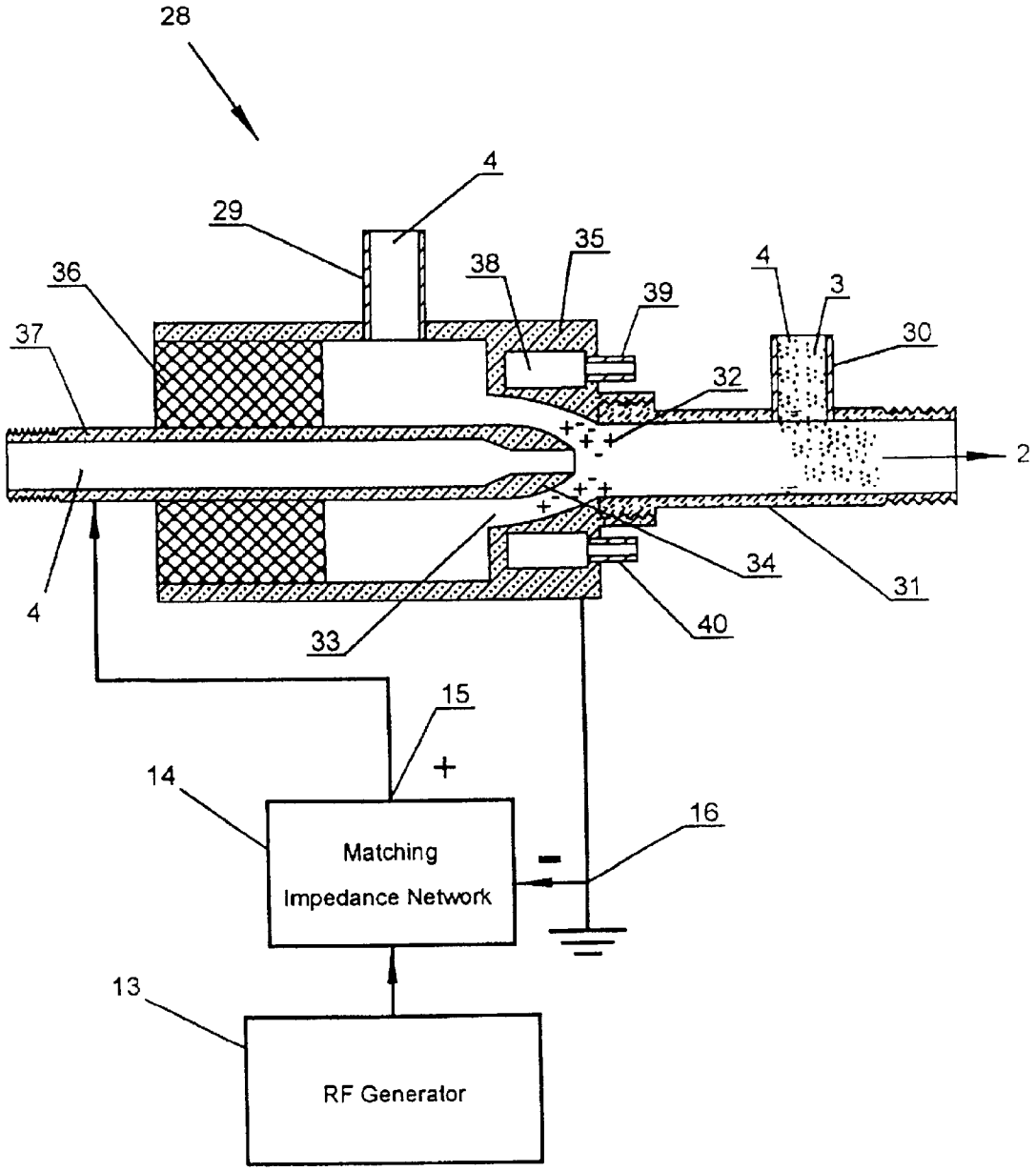
FIG. 6 is a combined block diagram and cross-section view of plasma reaction chamber with powder particle injection port for thermally altering and chemically reacting powder particles prior to acceleration in the friction-compensated sonic nozzle.

Alternatively, the powder particles 3 are thermal-plastic conditioned conventionally by flowing the carrier gas 4 with powder particle 3 mixture through a powder reactor consisting of a resistive or inductive heater as described in U.S. Pat. No. 6,074,135 issued to Tapphorn and Gabel. Or, as FIG. 6 shows, a complementary embodiment of the apparatus and process of the invention uses a high-pressure plasma reaction chamber 28 for heating or ionizing a mixture of carrier gas 4 and powder particles 3. Admixtures of chemicals may also be added to the carrier gas 4 for the purpose of chemically reacting the powder particles 3 or substrate 12 (FIG. 1). In one configuration of the plasma reaction chamber 28, the carrier gas 4 injected through port 29 is first heated or ionized within the plasma reaction chamber 28. Powder particles 3 entrained in carrier gas 4 are subsequently injected downstream through port 30 to heat or chemical react the powder particles 3 prior to acceleration through the friction-compensated sonic nozzle 2. The distance between the plasma reaction chamber 28 and the downstream injection port 30 is made adjustable by using different tube 31 lengths. The appropriate distance is determined by the gas temperature required for heating the powder particles 3 entrained in carrier gas 4 and the duration of reactant exposure required to achieve chemical treatment of the powder particles 3 or substrate 12. The invention reduces oxidation and chemical combustion of the powder particles 3 by thermal plastically conditioning the powder particles 3 within an inert carrier-gas 4 environment at relatively low temperatures compared to nearly molten (near the melting point) or molten powder particles 3.

In a modified operation of the plasma reaction chamber 28, the powder particles 3 entrained in carrier gas 4 may be injected through port 29 to heat, ionize, and chemically react the powders particles in-situ within the plasma generated in the plasma reaction chamber 28. Again, admixtures of chemicals may also be added to the carrier gas 4 for the purpose of chemically reacting the powder particles 3 and/or substrate 12 (FIG. 1). Admixtures of similar or different powder particles 3 entrained in carrier gas 4 may also be optionally injected downstream through port 30 to heat or chemically react the powder particles 3 at modified conditions (e.g., lower temperature or minimum ionization) prior to acceleration through friction-compensated sonic nozzle 2. This modified operation provides the means of mixing various types of powder particles 3 with different degrees of applied heat or chemical reactivity.

The thermal plasma 32 is generated in the circumferential passage 33 between the tip of the central electrode 34 and the concentric electrode housing 35. The central electrode 34 is connected to the RF anode potential 15 of the matching impedance network 14 connected to RF generator 13. Similarly, the concentric electrode housing 35 is connected to the RF cathode potential 16 of the matching impedance network 14 connected to RF generator 13. Reverse polarity in which the central electrode 34 is connected to the RF cathode potential 16 and the concentric electrode housing 35 is connected to the RF anode potential 15 is also included in the operational arrangement of the plasma reaction chamber 28. In this case, the concentric electrode housing 35 must be electrically isolated for RF voltages and frequencies. The RF power is electrically isolated for RF voltages and frequencies by the dielectric plug 36 installed between the central electrode 34 and the concentric electrode housing 35. The power output of the RF generator 13 is adjusted to achieve adequate heating of the powder particles 3 entrained in the carrier gas 4. Alternatively, the central electrode 34 could connect to a conventional AC/DC power supply equipped with a high-frequency arc starter/stabilizer unit for generating a thermal plasma 32 or arc in the circumferential passage 33 between the tip of the central electrode 34 and the concentric electrode housing 35. Typically for 20-micrometer aluminum particles in helium gas at 100 psig pressure and flow rates of 15 SCFM, an RF power of 500–1000 watts is required to heat the aluminum particles to a temperature of 400 Kelvin.

Cooling of the central electrode 34 is achieved by flowing a portion of the carrier gas 4 through tube 37. Optional cooling of the concentric electrode housing 35 is accomplished by flowing cooling fluid (e.g., water) through the circumferential annular cavity 38 fabricated into the concentric electrode housing 35 via inlet port 39 and outlet port 40.

Figure 7:
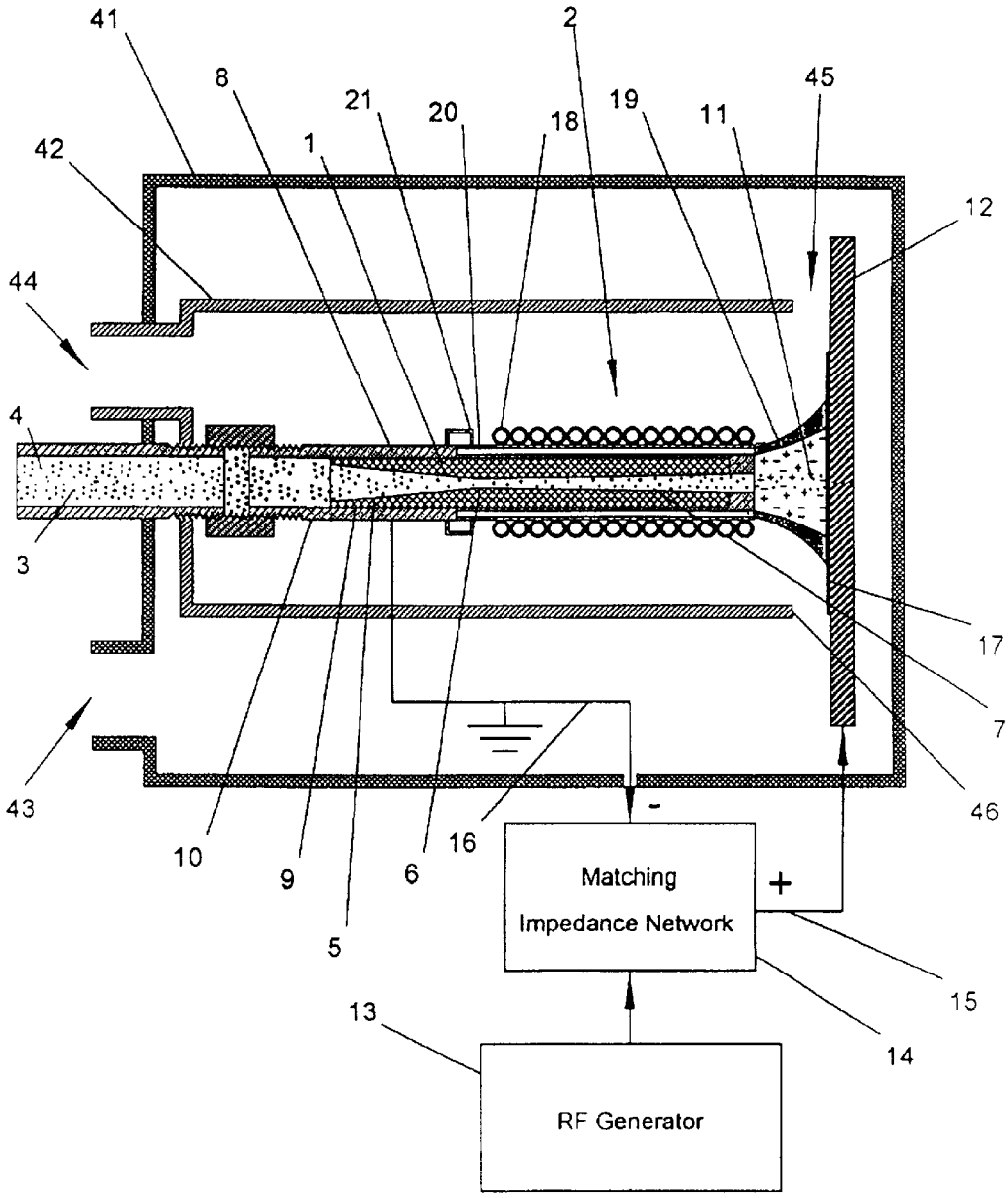
FIG. 7 shows a combined block diagram and cross-section view of the friction-compensated sonic nozzle mounted within a nested embodiment of an outer evacuator chamber and outer coaxial evacuator nozzle surrounding the friction-compensated sonic nozzle.

FIG. 7 shows a nested embodiment of an evacuator chamber 41 with an optional outer coaxial evacuator nozzle 42 surrounding the friction-compensated sonic nozzle 2 to accommodate the two-phase recovery of the carrier gas 4 and excess powder particles 3. The outer coaxial evacuator nozzle was first disclosed in U.S. Pat. Nos. 5,795,626 and 6,074,135 issued to the present inventors for use with supersonic nozzles. Two-phase effluent comprising carrier gas 4, excess powder particles 3, and other ablated substrate 12 material is evacuated from the outer evacuator chamber 41 and outer coaxial evacuator nozzle 42 and through ports 43 and 44, respectively, using a conventional dust collector. The dust collector (similar to conventional particle precipitating and filter units; U.S. Pat. No. 5,035,089 Tillman et al. or U.S. Pat. No. 4,723,378 VanKuiken, Jr. et al.) uses an exhaust suction blower to evacuate and filter the excess powder particles 3 and ablated substrate material entrained in the carrier gas 4, air, or other gases.

The carrier gas 4, air, other gases may be purified, recompressed, and recycled for economic purposes using conventional diffusion or cryogenic extraction methods. The excess powder particles 3 may also be recycled for environmental and economic purposes.

The outer coaxial evacuator nozzle 42 contour is designed to accommodate the two-phase fluid dynamic recovery of the carrier gas 4, excess powder particles 3, and ablated substrate 12 material. This particular embodiment of the outer coaxial evacuator nozzle 42 provides for a gas-bearing channel 45 between the outer coaxial evacuator nozzle 42 and the substrate 12. The influx of gas through the gas-bearing channel 45 provides a fluid dynamic gas bearing and prevents environmentally hazardous materials from escaping into the atmosphere. In an alternative implementation the lip 46 of the outer coaxial evacuator nozzle 42 is mounted in direct contact with the substrate 12 to form a seal. In addition to the combination of using an outer evacuator chamber 41 with an outer coaxial evacuator nozzle 42, a plurality of nested outer evacuator chambers 41 may also be used to provide differential gas-diffusion barriers. This approach maintains the concentration of a particular constituent of the carrier gas 4 (e.g., helium) at a sufficiently high level to enable economic recovery of said constituent.

Figure 8:
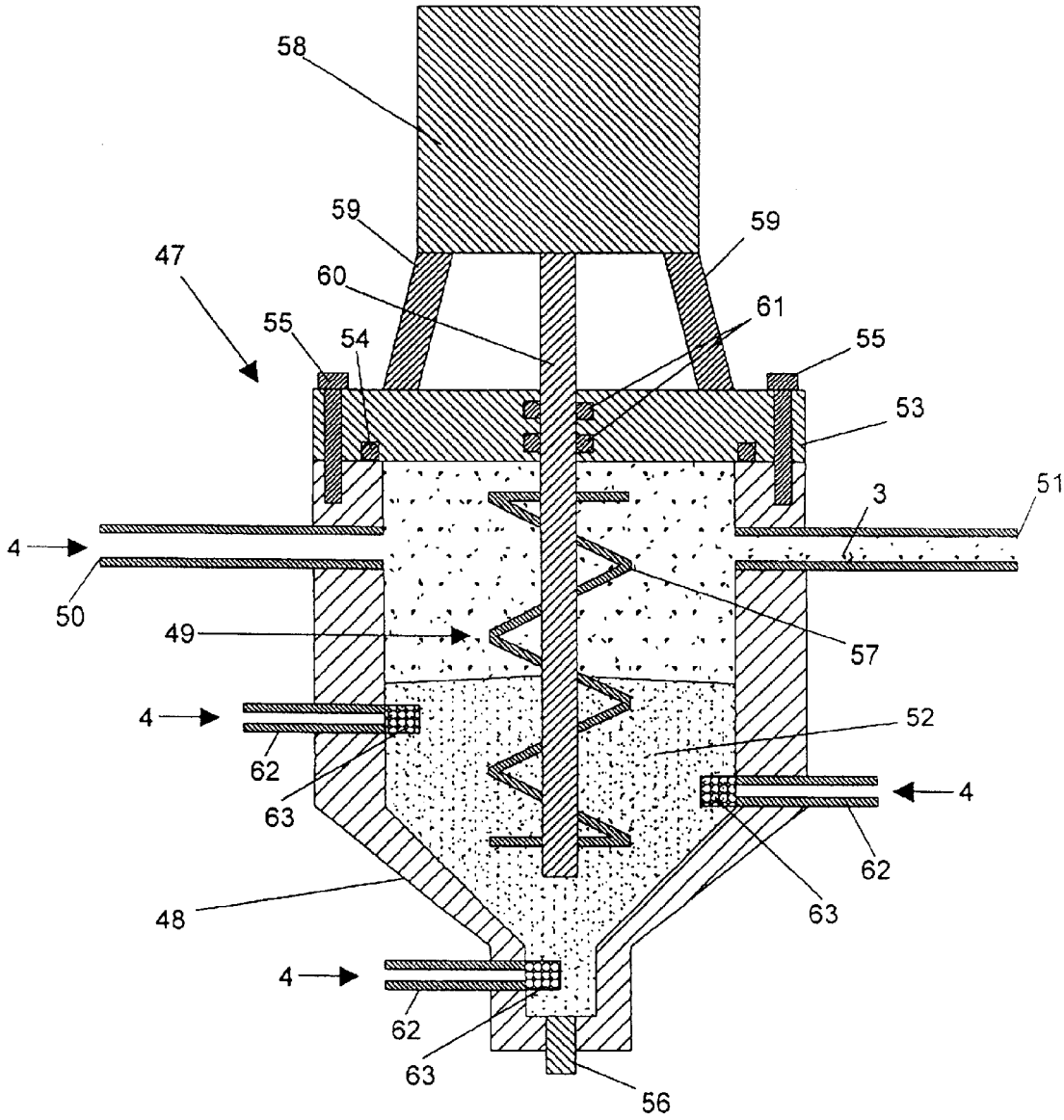
FIG. 8 is a side sectional view of a powder fluidizing unit for entraining powder particles into a high pressure process line using fluidizing ports and a motor driven agitator mechanism.

FIG. 8 shows a powder-fluidizing unit 47 suitable for use with the friction-compensated sonic nozzles 2 of the present invention. Powder fluidizing unit 47 includes a hopper 48, a mixing device 49, an inlet port 50, and an outlet port 51. Powder fluidizing unit 47 fluidizes and entrains a bulk powder 52 as powder particles 3 within a carrier gas 4. Powder fluidizing unit 47 is capable of creating a substantially uniform mixture of powder particles 3 and carrier gas 4 and allowing a high concentration of powder particles 3 to be fluidized and entrained within carrier gas 4.

Hopper 48 is a vessel, container, or conventional hopper designed to hold bulk powder 52. Hopper 48 includes a lid 53, O-rings 54, bolts 55, and a plug 56. Lid 53 is installed onto hopper 48 and sealed for high-pressure operation with one or more O-rings 54 by fastening lid 53 with bolts 55. Plug 56 may be used to seal a drain port in hopper 48 and to allow bulk powder 52 to be drained from hopper 48.

Inlet port 50 introduces carrier gas 4 into hopper 48. Mixing device 49 may be a mechanical or gas fluidizing device that mixes bulk powder 52 and carrier gas 4 in order to fluidize and entrain powder particles 3 within carrier gas 4. This mixture in the form of powder particles 3 entrained in carrier gas 4 then exits through outlet port 51, and may be sent to a powder reactor for treatment or to the friction-compensated sonic nozzle 2 described above. More than one powder-fluidizing unit 47 may be used in parallel feeding a plurality of friction-compensated sonic nozzles 2. Multiple powder-fluidizing units 47 may also be connected to a manifold connected to a single friction-compensated sonic nozzle 2 or to multiple friction-compensated sonic nozzles 2. The use of several powder-fluidizing units 47 connected via a manifold to a single friction-compensated sonic nozzle 2 or to multiple friction-compensated sonic nozzles 2 permits mixing different types of bulk powders 52 or different types of carrier gases 4.

Mixing device 49 may include an agitator 57 that can be driven at various controlled speeds. Agitator 57 may be an auger or similar screw-like device that can be operated at sufficiently high speeds to lift and fling bulk powder 52 into carrier gas 4. Agitator 57 is coupled to a motor 58 mounted to lid 53 with brackets 59 and coupled to agitator 57 via a shaft 60. Shaft 60 may rotate in lid 53 using one or more rotational seals 61 designed for high-pressure operation in an abrasive environment. Agitator 57 may also be a conveyor chain equipped with buckets that lift and dump bulk powder 52 into carrier gas 4. The speed of motor 58 connected to agitator 57 may also be adjusted and controlled to achieve a specific mass loading concentration of powder particles 3 entrained in carrier gas 4 prior to ejection into outlet port 51. This fluidization process is effective in selecting and entraining a distribution of powder particle sizes from bulk powder 52 by balancing the buoyancy and turbulent forces exerted by carrier gas 4 on powder particles 3 against the gravitational settling force. A conventional mechanical or electrical vibrator (not explicitly shown in FIG. 8) is typically attached externally to the hopper 48 for shaking the bulk powder 52 to the bottom of the hopper 48 if the vibration of the agitator 57 is insufficient.

Mixing device 49 may also include one or more fluidizing ports 62 positioned in the walls of hopper 48 and below the powder level in hopper 48. Each of the fluidizing ports 62 is arranged along the sidewall of hopper 48 to provide fluidization of bulk powder 52 as a function of depth. Each of the fluidizing ports 62 may include sintered metal filters 63 for uniformly injecting carrier gas 4, and for preventing backflow of bulk powder 52 into fluidizing ports 62. The pressure of carrier gas 4 injected into fluidizing ports 62 may be set higher than that of the pressure of carrier gas 4 injected into inlet port 50 and the flow rate of carrier gas 4 may be adjusted and controlled to achieve adequate fluidization of bulk powder 52.

Figure 9:
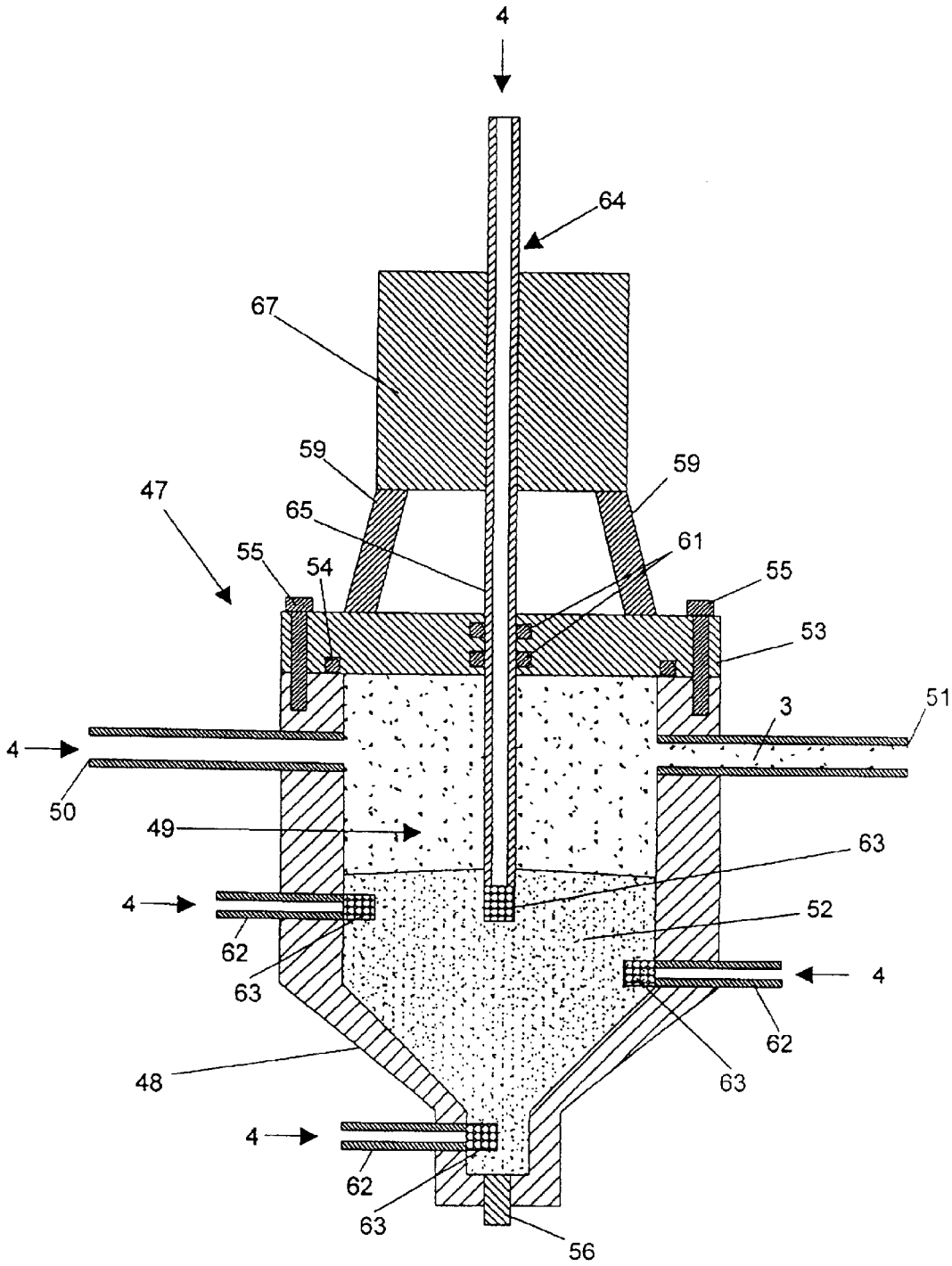
FIG. 9 is a side sectional view of a powder fluidizing unit for entraining powder particles into a high pressure process line using a movable fluidizing port mounted to the end of a tube that is connected to driving motor or mechanism for positioning the movable fluidizing port relative to bulk powder level.

Mixing device 49 may also consist of a movable fluidizing port 64 connected to the end of a tube 65 with a sintered metal filter 63 as shown in FIG. 9. Tube 65 extends through lid 53 with O-ring seals 66 and is connected to a driving mechanism 67 (e.g. linear motor) for changing the height of the movable fluidizing port 64 connected to end of said tube 65 relative to the powder level of bulk powder 52. By measuring the mass loss rate of bulk powder 52 withdrawn from the hopper 48 or by measuring the powder flow rate passing through outlet port 51 the height of the movable fluidizing port 64 may be varied to achieve a specific powder flow rate. Typically, conventional electronic or software PID (Proportional Integral Derivative) controllers that measure and sample the powder flow rate are used to adjust and maintain the driving mechanism 67 to a specific set point value. Again, a conventional mechanical or electrical vibrator (not explicitly shown in FIG. 9) is attached externally to the hopper 48 for shaking the bulk powder 52 to the bottom of the hopper 48.

EXAMPLE 1

Referring now to FIGS. 8 and 9, a bulk powder 52 is placed into hopper 48 of the powder fluidizing unit 47 and the pressure of carrier gas 4 injected into inlet port 50 is regulated to a value in the range of 50–250 psig. Carrier gas 4 may include but is not limited to air, argon, carbon tetrafluoride, carbonyl fluoride, helium, hydrogen, methane, nitrogen, oxygen, silane, steam, sulfur hexaflouride, or mixtures thereof in various concentrations. Carrier gas 4 is injected into fluidizing ports 62 and movable fluidizing port 64 of FIG. 9 and regulated to a higher pressure up to 500 psig. The differential pressure between carrier gas 4 injected into fluidizing ports 62 and carrier gas 4 injected into inlet port 50 is regulated at specific values depending on the location and depth of each fluidizing port 62 relative to bulk powder 52. Carrier gas 4 injected into a fluidizing port 62 at the greatest depth in bulk powder 52 has the largest differential pressure and is typically 25–100 psig above the inlet port 60 pressure. Similarly, carrier gas 4 injected into a fluidizing port 62 or movable fluidizing port 64 of FIG. 9 near the top of bulk powder 52 is regulated at a differential pressure of approximately 0–50 psig above inlet port 50 pressure. Carrier gas 4 injected into fluidizing ports 62 or movable fluidizing port 64 of FIG. 9 may be the same type of carrier gas 4 injected into the process line inlet port 50 or it may be a different type of gas to achieve a mixture thereof. The powder fluidizing unit 47 described in FIG. 8 is capable of entraining powder particles 3 in carrier gas 4 at concentrations up to 5% by weight depending on the density and particle size of bulk powder 52 and the differential pressures used at the fluidizing ports 62. At this concentration, coating deposition rates up to 1.0 lbm/h have been measured using the friction-compensated sonic nozzle 2 having an 0.0625-inch throat diameter with a distribution of powder sizes up to 45 microns in diameter and for various powder particle 3 densities up to 19 gm/cm$^3$. By adding an agitator 57 in the form of a rotating auger with a speed ranging from 0–200 rpm, bulk powder 52 is lifted and entrained in carrier gas 4 to achieve increased powder particle 3 concentrations up to 25% by weight in carrier gas 4. This enables increased deposition rates up to 5 lbm/h for a friction-compensated sonic nozzle 2 with a 0.0625-inch diameter throat. The deposition rates and required powder feeding rates will scale with the throat diameter of friction-compensated sonic nozzle 2, requiring corresponding increased flow rates of carrier gas 4. Flow rates and pressures of carrier gas 4 in combination with rotation speeds, diameter, and pitch of an auger provide a method for entraining powder particles 3 at specific concentrations in the high-pressure carrier gas 4; and subsequently injecting into high pressure outlet port 51. Deposition rates in excess of 5 lbm/h have been obtained using the powder fluidizing unit 47 described in FIG. 9 where the movable fluidizing port 64 is maintained at a depth of 3-cm below the level of the bulk powder 52 in the hopper 48 by driving mechanism 67. Thus, powder fluidizing units 47 described in FIGS. 8 & 9 overcomes the feeding uniformity limitations of gravity-fed or gear-metering powder feeders with respect to injection of nanoscale, ultra-fine, or fine powders into a high pressure process line at slow fluid velocities (<50 m/s).

Figure 10:
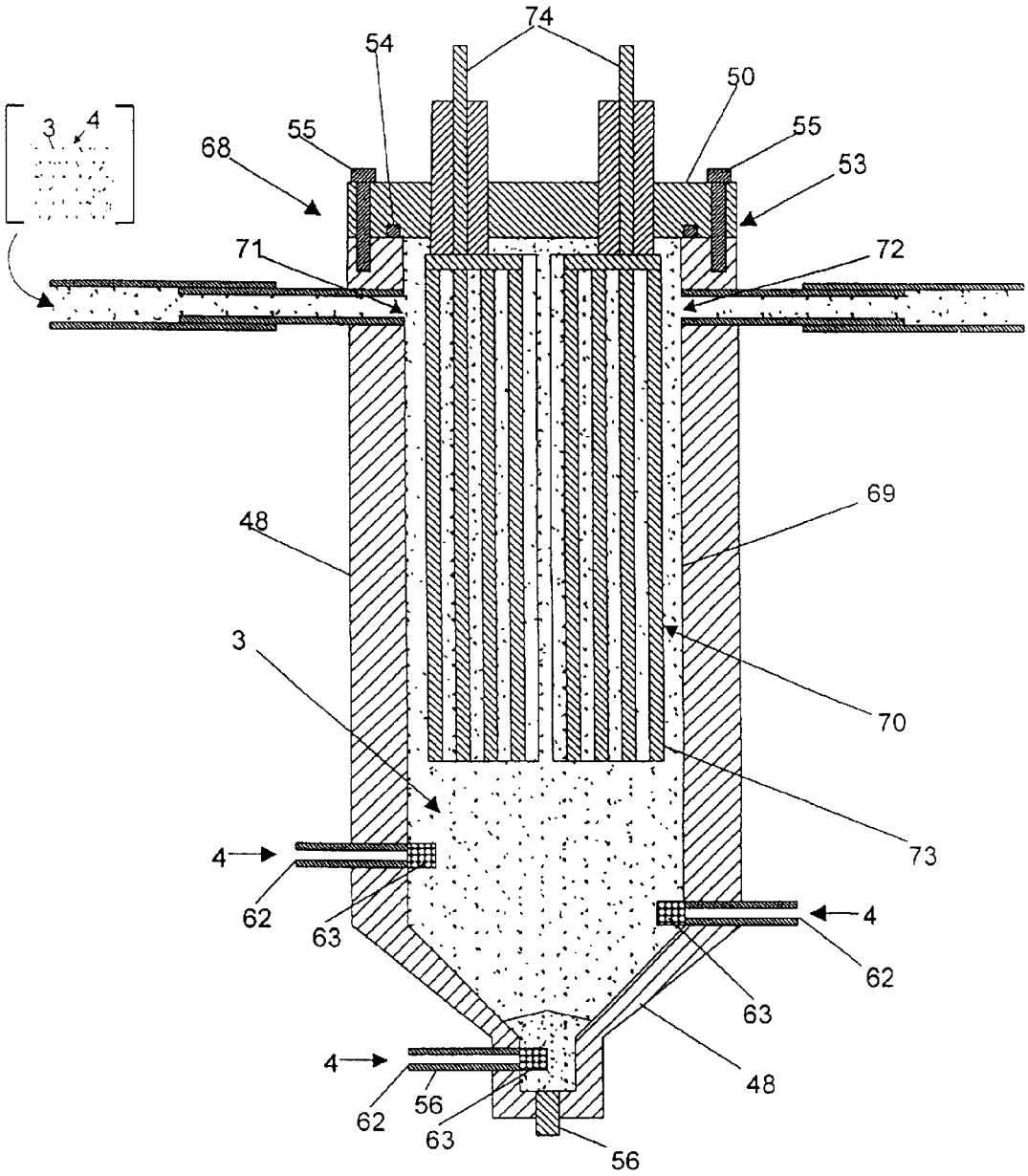
FIG. 10 is a side sectional view of a powder reactor comprising an inner element configured as baffles for mixing and treating powder particles entrained in a carrier gas.

FIG. 10 shows a powder reactor 68 suitable for use with the apparatus and process described in this invention for depositing and consolidating powder particles 3 onto substrates 12. Powder reactor 68 includes a cavity 69, a treatment device 70, an inlet port 71, and an outlet port 72. Powder reactor 68 permits the mixing and treating of powder particles 3 injected into cavity 69 by either a conventional powder feeder modified for high-pressure operation or by the powder fluidizing unit 47 shown in FIGS. 8 and 9. One or more conventional powder feeders or the powder fluidizing unit 47 may be used to inject various types of powder particles 3 into inlet port 71. Powder particles 3 are mixed and treated within powder cavity 69. This mixing and treatment may be facilitated by treatment device 70. One or more outlet ports 72 may be connected to a plurality of friction-compensated sonic nozzles 2 of this invention or connected to other applications requiring mixing and treating of bulk powders 52.

Lid 53, O-ring 54, bolts 55, and a plug 56 close cavity 69. Plug 56 may be used to seal a drain port in cavity 69 and to allow any bulk powder 52 to be drained from cavity 69.

Inlet port 71 introduces powder particles 3 entrained in carrier gas 4 into cavity 69. Treatment device 70 effects or facilitates a treatment of bulk powder 52 entrained as powder particles 3 within carrier gas 4. This treated mixture of powder particles 3 in carrier gas 4 exits through outlet port 72 and is delivered to friction-compensated sonic nozzles 2. More than one powder reactor 68 may be used in parallel feeding a plurality of friction-compensated sonic nozzles 2.

The mixing and powder treatments permitted by the powder reactor 68 depend on the specific requirements for treating the powder particles 3 entrained in carrier gas 4. One embodiment simply uses cavity 69 to classify said powder particles 3 by size and weight in the buoyant and turbulent carrier gas 4 with any excess powder particles 3 retrieved in the bottom of cavity 69. The placement of inlet port 71 and outlet port 72 is designed to sample the turbulent mixture at different spatial locations in order to modify the powder mass flow concentration or the fluidizing and mixing conditions of projectile particles 3 injected into powder reactor 68.

Treatment device 70 may include one or more fluidizing ports 62 positioned in various locations along the walls of cavity 69. Each of the fluidizing ports 62 may include a sintered metal filter 63 for uniformly injecting said carrier gas 4, and for preventing backflow of the powder particles 3 into fluidizing ports 62. These fluidizing ports 62 allow gases to be injected into cavity 69. These gases may be injected into fluidizing ports 62 at higher pressures than carrier gas 4 that is injected into inlet port 71. Treatment of powder particles 3 may include adding or mixing different types of gases through fluidizing ports 62 into cavity 69 to affect the properties of powder particles 3 entrained in carrier gas 4. These gases include but are not limited air, argon, carbon tetrafluoride, carbonyl fluoride, helium, hydrogen, methane, nitrogen, oxygen, silane, steam, sulfur hexaflouride, or mixtures thereof in various concentrations. Inert or reactive gases may also be used to affect the properties of the powder particles 3 entrained in carrier gas 4. For example, to remove an oxide film from the surface of projectile particles 2, the gas treatment may consist of injecting hydrogen at an elevated temperature to react chemically with the oxide layer material. This reaction removes oxygen as a contamination from powder particles 2.

Treatment device 70 may be a set of baffles 73 positioned within cavity 69 for mixing and treating powder particles 3 entrained in carrier gas 4. Baffles 73 may have different geometrical shapes designed to enhance the mixing and treatment feature of powder reactor 68. For example, FIG. 10 show baffles 73, which are arranged as concentric hemicylindrical shells. Baffles 73 may be inert elements used strictly for the purpose of modifying mixing and mass flow concentrations of the powder particles 3 entrained in carrier gas 4. Baffles 73 may be also be electrically active for enhancing the triboelectric charging of powder particles 3 prior to ejection into outlet port 72. In this case, baffles 73 are connected to a feedthrough electrode 74. Electrical power sources capable of delivering voltages up to the dielectric breakdown voltage of the carrier gas 4 with entrained powder particles 3 may be used to enhance the triboelectric charging of powder particles 3 through charge induction. This voltage may range anywhere from 50 to 50,000 volts.

Treatment device 70 may also be a sieve or filter positioned within cavity 69 for screening powder particles 3 entrained in carrier gas 4. This design enables classification of powder particles 3 into a specific particle size distribution prior to ejection into outlet 72. For example, a 325-mesh sieve may be installed in the form of a single element within cavity 69 to screen powder particles 3 down to sizes below 45 micrometers before ejection into outlet port 72.

Treatment device 70 may also be an induction coil positioned within cavity 69 of powder reactor 68. The induction coil is connected via feedthrough electrodes 74 to a radio-frequency voltage source for inductively heating powder particles 3 entrained in carrier gas 4 prior to ejection through outlet 72. This voltage source may be capable of delivering from 0.5 to 1,000 kW of power.

Treatment device 70 may consists of sets of radiator panels that are heated by electrical resistive coils attach to the radiator panels and powered through electrodes 74. For example, treatment device 70 in the form of electrical resistive coils may be used to heat a mixture of carrier gas 4 and powder particles 3 up to an elevated temperature while flowing through a cavity 69 having a cylindrical shape. This particular configuration requires up to 5 kW of electrical power to heat a nitrogen or helium carrier gas flowing at 10–25 lbm/h with entrained aluminum powder particles at a concentration of 5% by weight. The helium carrier gas is regulated to a pressure of 200 psig.

The electrical resistive coils, described above, may be replaced by a coolant line interfaced into the cavity 69 in lieu of the electrodes 74 with a feedthrough coolant line that is used to flow a refrigerant liquid such as Freon through conventional coils attached to treatment device 70 configured as a radiator.

Powder reactor 68 may also be configured to permit the coating of powder particles 3 entrained in carrier gas 4 with a second material prior to ejection into outlet port 71. Methods of coating include evaporation, physical vapor deposition, chemical vapor deposition, or sputtering of a second material via a resistive heater, an arc, a plasma, or laser ablation of the second material in the presence of the turbulent mixture consisting of powder particles 3 entrained in carrier gas 4. Powder particles 3 are coated by using a treatment device 70 with the appropriate physical or chemical apparatus for generating a vapor or molecular states of the second material to be deposited on the surface of projectile particles 3 entrained in carrier gas 4 during passage through powder reactor 67.

Figure 11:
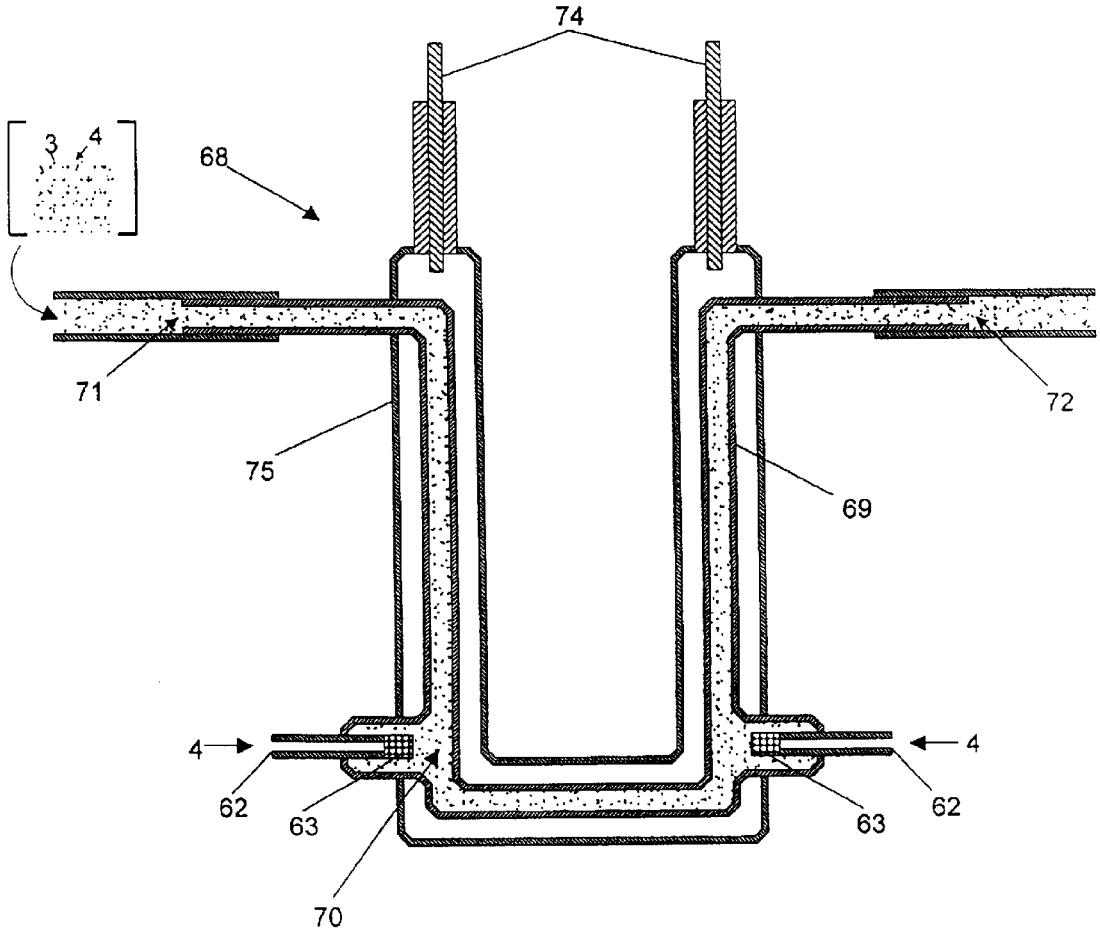
FIG. 11 is a side sectional view of a powder reactor comprising an inner element configured as a tubular structure for mixing and treating powder particles entrained in a carrier gas.

FIG. 11 shows an embodiment of powder reactor 68 that uses a tubular cavity 69 design to implement the mixing and treatment features of powder reactor 68. Powder reactor 68 includes a tubular cavity 69, a treatment device 70, an inlet port 71, and an outlet port 72. This configuration is designed to convey powder particles 3 entrained in carrier gas 4 through tubular cavity 69 while modifying the properties of powder particles 3 through physical interactions, chemical reactions, or nuclear reactions. The length of tubular cavity 69 may be selected to permit the reactions to proceed to the desired extent during passage of powder particles 3 entrained in carrier gas 4 through tubular cavity 69.

Treatment device 70 may include a heating or cooling device coupled to tubular cavity 69. Such a heating or cooling device may take the form of an outer jacket 75 positioned in a concentric fashion around tubular cavity 69. Outer jacket 75 includes electrodes 74 or coolant line feedthroughs, which are capable of heating or cooling a thermally or electrically conductive media located in the space between the outer jacket 75 and tubular cavity 69.

This feature provides the means of heating or cooling powder particles 3 entrained in carrier gas 4 by conduction, convection, and radiation of heat from the sidewalls of tubular cavity 69 prior to ejection through outlet port 71. Resistive heater coils may be connected to electrodes 74 and installed in a thermally conductive, but electrically insulating media between outer jacket 75 and tubular cavity 69. Alternatively, via conventional coolant line feedthroughs in lieu of electrodes 74, liquids or gases (e.g., steam, oil, or freon refrigerant) may be circulated between outer jacket 75 and tubular cavity 69. Again, heating or cooling of powder particles 3 entrained carrier gas 4 occurs by heat exchange (conduction, convection, and radiation) between the sidewalls of tubular cavity 69 and powder particles 3 entrained in carrier gas 4 prior to ejection through outlet port 72.

The heating or cooling treatment of powder particles 3 entrained in carrier gas 4 is used to modify the physical properties of powder particles 3. The heating or cooling treatment may also be used to promote chemical reactions between carrier gas 4 and powder particles 3, thereby modifying the chemical properties of projectile particles 3. In addition, by cooling the mixture of projectile particles 3 entrained in carrier gas 4, the treatment process permits the removal of contamination products. For example, high temperature hydrogen may be used as a reducing agent to remove the oxide layer from powder particles 3 and produce steam. This steam is removed from carrier gas 4 by cooling the gas and entrained powder particles 3 below the condensation temperature for water vapor.

Treatment device 70 may also include one or more fluidizing ports 62 coupled to tubular cavity 69. Additional or different carrier gases 4 may be injected into these fluidizing ports 62 at higher pressures than carrier gas 4 that is injected into inlet port 71 of tubular cavity 69. Fluidizing ports 62 can also be used to repetitively exchange carrier gas 4 from one type of gas to another type of gas at various stages along the flow path of tubular cavity 69. Each of the fluidizing ports 62 may include a sintered metal filter 63 for uniformly injecting carrier gas 4 and for preventing back-flow of powder particles 3 into fluidizing ports 62. Each of the fluidizing ports 62 is arranged along the walls of tubular cavity 69 at various stages required to implement the required physical or chemical reaction kinetics.

Powder reactor 68 with tubular cavity 69 can be configured to permit powder particles 3 entrained in carrier gas 4 to be conveyed to a remote powder reactor such as a nuclear reactor. This permits powder particles 3 entrained in carrier gas 4 to be activated by neutron reactions prior to ejection into outlet port 72. This process may be used to coat or spray-form radioactive materials or other isotopes of the powder particles 3.

A plurality of powder reactors 68 may be connected in series to achieve a desired sequence of processes. For example, one powder reactor 68 using tubular cavity 69 could be used as a hydride reactor feeding into a second powder reactor 68 with tubular cavity 69 that functions as a dehydride reactor. In this configuration, the first powder reactor 68 converts powder particles 3 in the form of a metal into a metal hydride, while the second powder reactor 68 reverts powder particles 3 in the form of a metal hydride back to an oxygen free metal. In addition, a plurality of powder reactors 68 connected in series may be used to repetitively heat and cool powder particles 3 entrained in carrier gas 4. This process may be used to break down friable powder particles 3 in the form of metal hydrides, such as titanium and uranium hydride, into powder particles 3 with submicron and nanoscale dimensions. In detail, the mixing and treatment feature of powder reactor 68 includes a chemical reactor for chemically modifying the chemical properties of powder particles 3 entrained in carrier gas 4 prior to ejection into outlet port 71. In addition to reciprocally heating or cooling, each powder reactor 68 can be also be used to expose the powder particles 3 to different types of carrier gases 4.

For example, the spraying of oxygen-free titanium powder can be accomplished by first converting powder particles 3 in the form of titanium metal to titanium hydride by exposing powder particles 3 to carrier gas 4 in the form of hydrogen at a temperature of approximately 750 K. At this temperature, the treatment also removes the metal oxide from the titanium powder particles 3 by reacting the hydrogen carrier gas 4 with the oxide layer to produce steam. By reciprocally heating and cooling the titanium-hydride powder particles 3 between 300 K and 750 K using hydrogen as carrier gas 4, this latter process can be used to break down friable powder particles 3, such as titanium hydride, into finer or nanoscale powder particles 3. A final stage powder reactor 68 may be used to inject an inert carrier gas 4 such as helium at a temperature in excess of 820 K. This process reverts the titanium hydride powder particles 3 entrained in carrier gas 4 back to oxygen-free titanium metal prior to ejection into outlet port 72.

The chemical reaction kinetics determines the duration for the passage of powder particles 3 through each of the powder reactors 68 at a particular temperature and partial pressure of the gaseous reaction products. This determines the specific length of tubular cavity 69 required for implementing a particular treatment process within powder reactor 69. For example, powder reactor 68 may have tubular cavity 69 which has been designed with a tube approximately 50–100 feet in length and is heated with electrical resistive coils positioned in a thermally conductive media installed in the space between outer jacket 75 and tubular cavity 69. This particular design requires up to 50 kW of electrical power to heat hydrogen or helium carrier gas flowing at 25 lbm/h with entrained titanium powder particles 3 (concentration of 5% by weight) to a 700–1000 K temperature. The powder reactors 68 permit production of oxygen free titanium powder particles 3 (<45 micrometers diameter) through the hydride and dehydride process described above. Coating deposition and spray forming of the oxygen free titanium projectile particles was accomplished using the coating or ablation applicator described above with helium as the carrier gas and projectile particles in the form of titanium hydride.

Figure 12:
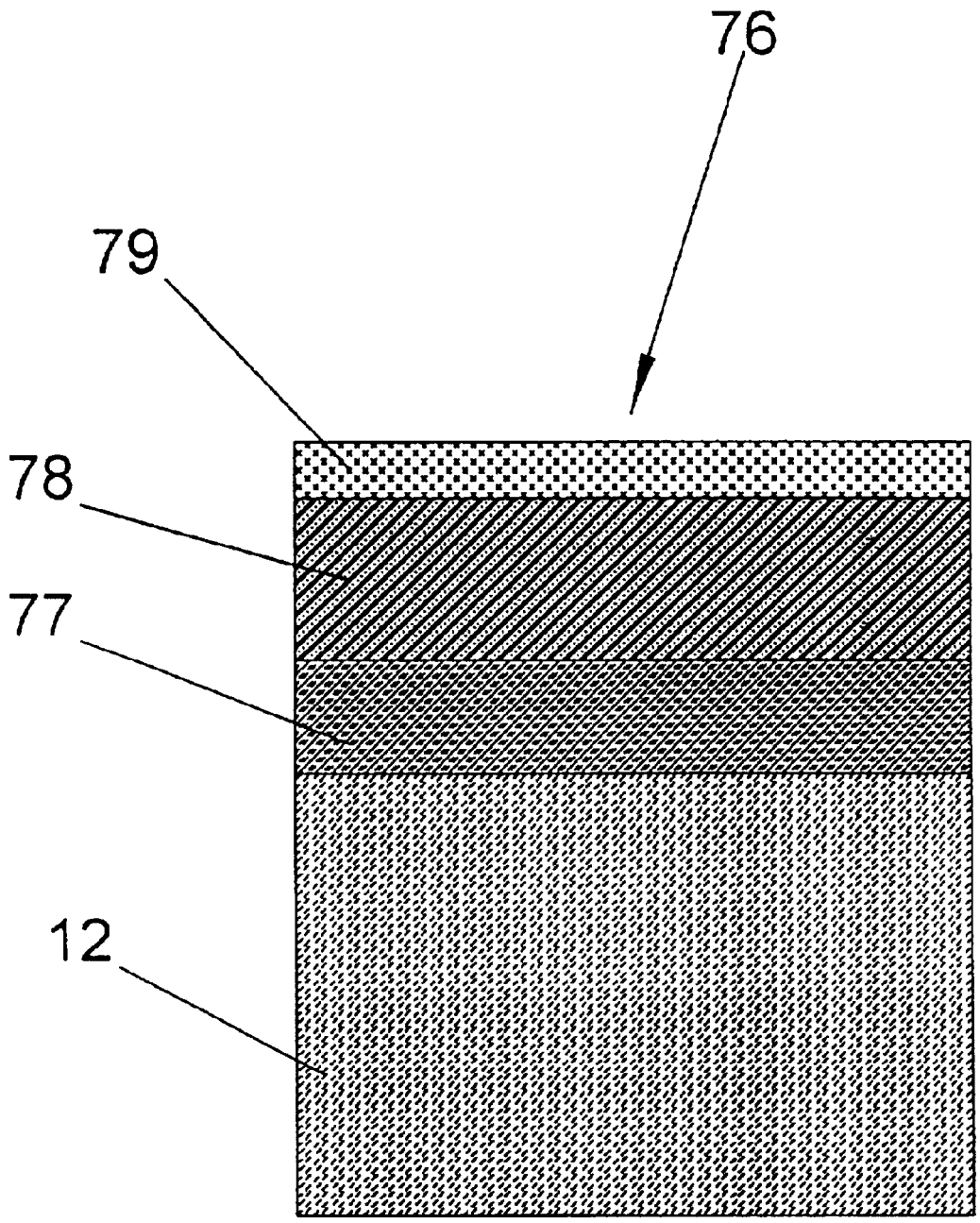
FIG. 12 illustrates a cross-section view of a multi-layer coating deposited on a substrate using the applicator and process described in this invention.

Referring now to FIG. 12, the application and process of the invention provides a method for depositing a multi-layer coating 76 to the surface of a core aluminum alloy substrate 12 comprising multiple monolithic layers; a corrosion protective or diffusion limiting undercoat 77, a braze filler coating 78, and a flux coating 79. This method uses the unique apparatus and process of the present invention to control the consolidation physical state of the various layers of the multi-layer coating 76.

Zinc is frequently used as corrosion protective undercoat 77 (other metal powders include but are not limited to aluminum, copper, manganese, tin, or titanium) and is applied to core aluminum alloy substrate 12 at a nominal thickness of 1–10 micrometers using the applicator and process of this invention. A single nozzle or plurality of friction-compensated sonic nozzles (2 of FIGS. 1–3) is translated in a raster fashion to permit contiguous coating of sheet substrate 12 or a specific region of a core aluminum alloy part. The second layer of the multi-layer coating 76 is a braze filler coating 78 (e.g., 4343, 4044, 4045, 4145, or 4047 aluminum silicon alloys) and is applied to a thickness of 10–1000 micrometers as metallic powder to the corrosion protective undercoat 77 using a single or plurality of nozzles (2 of FIGS. 1–3). Finally a flux coating 79 (1–5 micrometers thick) of nickel or cobalt flux powder is applied to the surface of the braze filler coating 78 using a single nozzle or plurality of friction-compensated sonic nozzles (2 of FIGS. 1–3) to form the final layer of a multi-layer coating 76.

Note the braze filler (e.g., 4043, 4044, 4045, 4145, or 4047 aluminum-silicon alloys) could be conventionally bonded or cladded to the sheet stock or component of a core aluminum-alloy base material, in which case only the flux coating 79 (e.g., nickel or cobalt flux powder) is applied to the surface of the cladded sheet stock using a single nozzle or plurality of friction-compensated sonic nozzles (2 of FIGS. 1–3) described in the apparatus and process of this invention.

Using conventional brazing methods [Aluminum Brazing Handbook, The Aluminum Association, 900 19$^{th}$ Street, N. W., Washington, D.C. 4$^{th}$ Edition 1998], a mating piece of similar or different aluminum-alloy core material is then placed in intimate contact with the multi-layer coating 76 and the temperature raised within an inert gas or vacuum furnace to complete the brazing process. At a temperature of 840 K the nickel or cobalt flux coating 78 reacts with the braze filler coating 77 or the braze coating of a cladded aluminum alloy sheet stock to form a eutectic layer that permits bonding of the two aluminum alloy parts. Typically most aluminum brazing is performed at temperatures between 844 K and 894 K for aluminum-silicon braze fillers like 4343, 4044, 4045, 4145, or 4047 alloys. Thus, the nickel or cobalt flux coating 78 promotes bonding of the braze filler coating 77 at a temperature that is slightly below the conventional brazing temperatures. This allows a larger temperature margin in braze manufacturing without the risk of melting the structural core material.

As an alternative to metallic flux coatings 79, potassium fluoro-aluminate salts in the form of fine particles may be applied to the braze filler coating 78 using a single nozzle or plurality nozzles (2 of FIGS. 1–3) as described in the apparatus and process of this invention. In this case, the flux coating 79 is applied only to the thickness required to fill the semi-porous surface structure of the braze filler coating 78. For cladded sheet materials, it may be necessary to conventionally abrade the surface to produce a semi-porous surface structure in which to embedded the potassium fluoro-aluminate salt particles as a powder. Finally, a braze filler coating 78 and flux coating 79 composite of potassium fluoro-aluminate salts may also be applied to a core aluminum alloy substrate 12 by co-deposition of a mixture of potassium fluoro-aluminate salt powder with a braze-alloy powder (e.g., 4343, 4044, 4045, 4145, or 4047 alloys) using a single friction-compensated sonic nozzle or plurality nozzles (2 of FIGS. 1–3) described in the apparatus and process of this invention. In this case, flux powder (potassium fluoro-aluminate salt) is heated during transit through the thermal-transfer plasma 11 for adherence to the metallic braze-alloy powder and embedded into the substrate 12 surface by the collision impact process associated with plastic deformation of the powder particles 3. The plasma reaction chamber 28 of FIG. 6 provides the most innovative means of co-depositing a mixture of potassium fluoro-aluminate salt powder with a braze-alloy powder. The admixture of potassium fluoro-aluminate salt powder is injected downstream from the reaction chamber 28 through port 30 into braze powder particles 3 entrained in the hot carrier gas 4. The co-deposition process allows the braze filler coating 78 and flux coating 79 to be simultaneously applied to the substrate 12 surface as a composite coating with a metallic powder that is compatible with the braze alloy and does not effect the performance of the subsequent brazing. The recommended brazing temperature using the potassium fluoro-aluminate salt flux depends on the melting temperature of the braze filler, but typically for the 4047 alloy the temperature is 855 to 877 K.

EXAMPLE 2

Thermal performance of multi-layer coatings 76 applied with the applicator and process of this invention were tested by brazing core aluminum alloy substrates and metallurgically evaluated to determine the porosity of the joint and to examine the substrate 12 adhesion. The thermal performance was assessed by measuring the thermal diffusivity of a typical braze joint.

A 3000 series aluminum alloy was coated with thermal-plastic conditioned 4047-alloy powder (no undercoat) to a thickness of 40 micrometers using the applicator and process described in this invention. Additionally, a flux coating 79 of potassium fluoro-aluminate salt powder was heated and embedded into the semi-porous structure of the 4047-alloy braze filler coating 78 using the applicator and process described in this invention. This multi-layer coating 76 was tested by fabricating a braze joint. The joint exhibits low porosity in combination with the excellent metallurgical bonding to ensure good thermal transfer characteristics for the heat exchanger applications. Qualitative mechanical peel tests were conducted to assess the mechanical integrity of the braze joint and the results were comparable to brazed joint formed with cladded material. Thermal performance testing of brazes produced with multi-layer coatings 76 deposited using the applicator and process referenced herein were assessed by measuring the thermal diffusivity for a fixed joint configuration. These results gave comparable thermal diffusivities between a brazed joint formed with cladded material and a braze joint formed with a multi-layer coating 76. Both results were consistent (within ±5%) with a thermal diffusivity of 0.97 $cm^2s^{-1}$ for aluminum.

Figure 13:
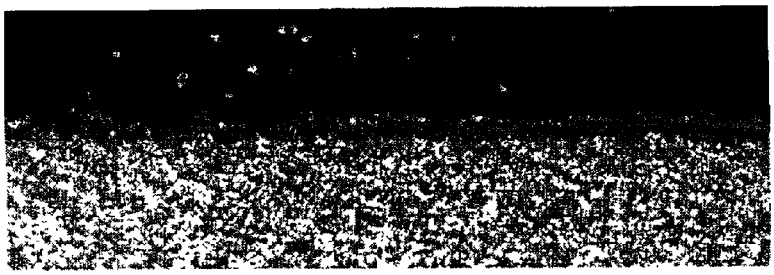
FIG. 13 is a micrograph image of nickel flux coating on an aluminum substrate.

Additional performance tests of multi-layer coatings 76 were evaluated by applying a flux coating 79 of thermal-plastic conditioned nickel powder to the surface of a 3000 series alloy that had been conventionally cladded with a 4047 eutectic braze alloy. The nickel flux coating 79 was deposited using the applicator and process of this invention to a thickness of 8–10 micrometers as typically shown below. A braze joint was formed at a temperature of 840 K in a tube furnace using a helium gas purge. Qualitative mechanical peel tests were conducted on the joint and found to be excellent. Thus, the nickel flux coating 79 permits brazing of the 3000 series alloy material at temperature that is 13 K cooler than the typical brazing temperature of the 4047 braze filler using potassium fluoro-aluminate salt, as depicted in FIG. 13.

The apparatus and process of this invention also permits depositions of functionally graded materials in which the properties (e.g., thermal expansion, thermal conductivity, strength, ductility, corrosion resistance, color, etc.) of the deposition are functionally graded in discrete or step-wise layers as well as continuously graded. Continuous grading of functionally graded coatings is accomplished by co-depositing powder mixtures in which the concentration of admixtures is varied as a function of coating thickness. For example, the co-deposition of molybdenum powder with admixtures of copper powder can be used to tailor the thermal expansion properties of the deposition from $4.8 \cdot 10^{-6}$ $K^{-1}$ for pure molybdenum to $16.6 \cdot 10^{-6}$ $K^{-1}$ for pure copper. The thermal expansion coefficient of the deposition is proportional to the concentration of the copper admixture powder in the molybdenum powder as a function of thickness.

EXAMPLE 3

Referring again to FIGS. 4 and 5, the application and process of the invention provides a method for spray forming materials onto a substrate 12 or for spray forming a raised fillet 22 between two separate pieces 23 and 24 that are joined by fusing materials. Thus, depending on the choice of powder particles 3, substrate 12 materials, and applied RF generator 13 power the apparatus and process of this invention can be used not only for spray forming of materials, but also joining similar or dissimilar materials by fusion.

The friction-compensated sonic nozzle 2 (referring to FIGS. 4, 5, and 6) may also be used to spray-form metals and metal-matrix composites into near-net shape. The near-net shape is enabled by robotic control of friction-compensated sonic nozzle 2 such that various geometrical shapes are spray-formed onto substrate 12 with each pass. Build-up is controlled by the dwell time over specific locations. Dwell times can range from a few milliseconds to times as long as minutes depending on the near-net shape structure being fabricated. Millisecond dwell times may be used to produce thin coatings with uniform buildup using multiple passes. Longer dwell times on the order of seconds to minutes may be used to build up a spire or column deposition or to fill in a hole in substrate 12.

Variation of these dwell times may be coupled with spatial and angular robotic manipulation of friction-compensated sonic nozzle 2 to enable the near-net-shape fabrication process using the coating or ablation applicator of this invention. In ablation applications, the applicator under robotic manipulation with variation in dwell times may be used to remove or ablate materials from substrate 12 so as to cut a near-net-shape pattern. A mask placed over substrate 12 may also used to perform other variations of near-net-shape manufacturing. Friction-compensated sonic nozzle 2 may be robotically positioned to dwell for prescribed periods of time necessary to coat or spray form a near-net-shape feature through the mask. The mask should be constructed from a material that precludes buildup of powder particles 3 onto the mask. Likewise, dwelling for a prescribed period of time at a hole in the mask may use the mask to fabricate near-net-shape indentations into substrate 12.

By simultaneously using a plurality of friction-compensated sonic nozzles 2 it is possible to have multiple friction-compensated sonic nozzles 2 simultaneously spray forming over the same substrate 12 location to enhance the buildup rate or modify the near-net shape of the deposition. Orthogonal friction-compensated sonic nozzles 2 housed within an outer evacuator chamber 41 is one example of an application using a plurality of friction-compensated sonic nozzles 2 to fabricate nose-cone shaped components.

Spraying of nanoscale, nanophase, and amphorous powders mixed with other micron size powders permits nanoscale and nanophase materials to be added as an ex-situ strengthening agent to a spray-formed metal matrix composite or to a coating. Spraying of nanoscale, nanophase or amphorous powders independently (i.e., without micron size powder mixtures) is also permitted by the coating and ablation applicator of this invention.

The properties of the spray formed materials are controlled by simultaneously coupling the kinetic energy of the particle transferred to the impact process with the thermal-plastic conditioned powder particles 3 and substrate 12 material to control the consolidation physical state. Annealing, hot isostatic pressing, and or melting of the powder particles 3 and substrate 12 material is frequently required in spray forming substrate 12 materials to near-net shape or for spray forming a raised fillet 22 between two separate pieces 23 and 24 that are joined by fusing materials.

Spray forming of in-situ or ex-situ particle reinforced metal matrix composites is enabled by the apparatus and process of this invention using powder mixtures that functionally form unique strengthening phases. In-situ metal matrix composites are co-deposited as a mixture and then functionally formed into a particle reinforced strengthening phase after exposure to a post deposition heat treatment. The application of the apparatus and process of the invention permits the combinations of metals such as aluminum and a group of metals selected from transition elements including but not limited to cobalt, copper, iron, nickel, titanium, or silver to be sprayed formed in the thermal-plastic conditioned metallic state. An optional post-deposition heat treatment at the intermetallic reaction threshold converts the transition metal to an in-situ intermetallic-strengthening phase dispersed within the aluminum matrix material. This application of the invention is not only applicable to aluminum and admixtures of transition metals, but may be used for any combination of powders selected from a group comprising metallic materials, metallic alloy materials, nonmetallic materials, and mixtures thereof.

Figure 14:
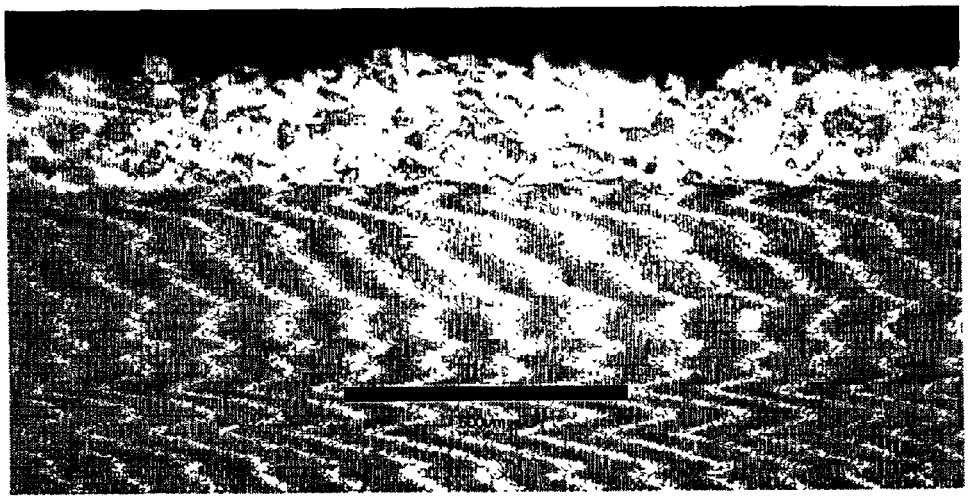
FIG. 14 is a micrograph image of a aluminum-chromium metal matrix composite coated on steel.

The apparatus and process of this invention includes a method for co-deposition of composite coatings that have not been metallurgically alloyed, but consolidated to full composite density. Consolidation of such metallic powders with other metallic or nonmetallic powders permit tailoring of coatings or spray formed material properties. For example, by co-depositing a mixture of thermal-plastic conditioned aluminum and chromium powders (equal parts by weight), an electrically conductive strip can be applied to a steel substrate that has a tailored electrical resistivity (i.e., typically 72 $\mu\Omega$-cm), excellent corrosion resistance (20 years in salt spray at 70° F.) and an adhesion strength superior to that of pure aluminum on steel. The micrograph in FIG. 14 shows an example of a steel substrate coated with a metal matrix composite formed by co-deposition of thermal-plastic conditioned aluminum powder with 50% by weight of chromium powder (<44-micrometer particles) using the applicator and process of this invention.

Figure 15:
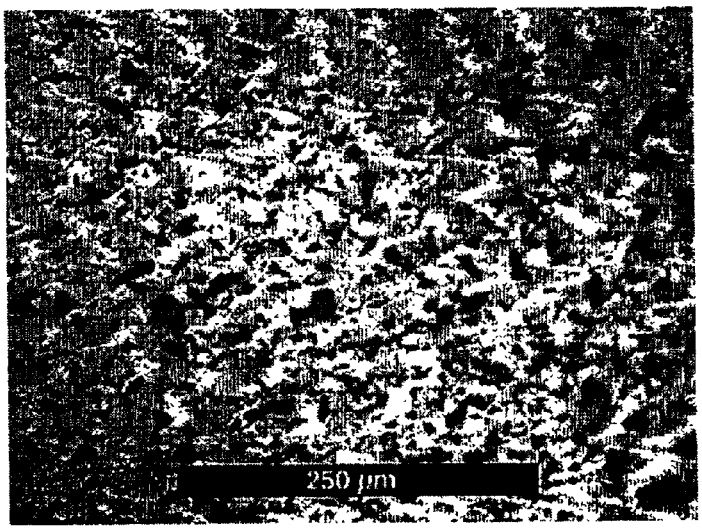
FIG. 15 is a micrograph image of the cross-section of a 6061Al—SiC ex-situ spray formed particle reinforced metal matrix composite.

The apparatus and process of this also permits a process for spray forming ex-situ particle reinforced metal matrix composite materials by using strengthening agents select from a group comprising silicon carbide, boron carbide, tungsten carbide, or alumina powders. The strengthening agents are co-deposited and spray formed as an admixture with a thermal-plastic conditioned matrix powder such as aluminum or titanium. A light microscope cross-section of an ex-situ particle reinforced metal matrix composite materials comprising silicon carbide particles in an aluminum alloy matrix is shown in FIG. 15. Note the excellent dispersion of the ex-situ strengthen agents within the aluminum matrix that cannot be achieved with conventional casting methods of forming these composite materials.

Thus the apparatus and process of this invention teaches a spray forming method for consolidating metallic and nonmetallic powders onto a substrate surface without significant metallurgical, chemical, or mechanical alteration of the substrate material. Not only does the invention provide a means of consolidating pure metal or alloy powders into near-net shape, but the technology also enables the spray forming of both in-situ and ex-situ particle reinforced metal matrix composite materials. Applications for this process include deposition of wear resistant layers onto friction surfaces such as aluminum cast brake rotors, deposition of wear resistant layers onto aluminum sheet stock, and deposition of metallic and nonmetallic layers onto aluminum sheet stock for machining and polishing.

EXAMPLE 4

Finally, the apparatus and process of this invention also includes consolidation of functionally graded materials in which the properties of the deposition (e.g. thermal expansion, thermal conductivity, strength, ductility, corrosion resistance, color, etc.) are functionally graded in discrete or step-wise layers as well as continuously graded. Continuous grading of functionally graded materials is accomplished by co-depositing powder mixtures in which the concentration of each powder is varied as a function of coating thickness.

A combination of functionally formed and functionally graded materials is included in the invention. An example of this embodiment includes encapsulation of an inner core of material (e.g. metallic alloy, metallic foam, ceramic or composite) with a monolithic layer, functionally graded layer of materials, functionally formed in-situ composite or functionally formed ex-situ composites to tailor specific properties of the finished part or component.

Figure 16:
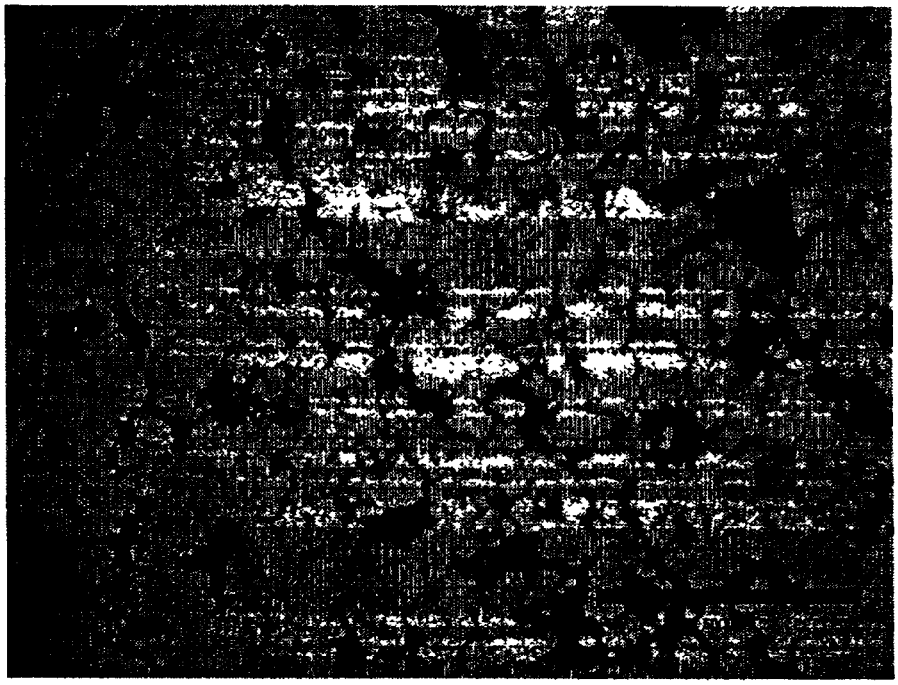
FIG. 16 is a micrograph image of a porous titanium consolidation deposited as a coating on a substrate surface.

The invention also includes the consolidation of porous coatings or spray formed materials by controlling the particle-size distribution of the powder during the deposition process. Large powder particles (>325 mesh) consolidated without an admixture of fine or ultra-fine particles (<325 mesh) produces materials with high porosities. These types of consolidations provide the means for producing porous structures for catalytic reactors, filters, and matrices for encapsulating or sealing admixtures of other metallic and nonmetallic materials. For example, a porous matrix of titanium powder deposited as a coating on a substrate surface, such as depicted in FIG. 16, can be sealed with epoxy for providing an excellent corrosion resistant coating on reactive metal surfaces. In another example, pyrophoric materials can be injected into a metallic matrix for controlling the pyrophoric reactivity, temperature, and spectral emission of a pyrophoric flare.

It is noted that while the foregoing apparatuses and processes according to the present invention for generating and employing a thermal-transfer plasma or high-pressure thermal plasma to heat the powder particles entrained in the carrier gas, heat the substrate materials, and/or chemically react the powder particles and substrate materials, were described in connection with their use with the unique friction-compensated sonic nozzle, this need not be the case. These same apparatuses and processes can also be advantageously employed in combination with systems using conventional supersonic nozzles and supersonic jets such as those described previously in the Background section.

Although scope of the apparatus and process of this invention has been described in detail with particular reference to preferred embodiments, other embodiments can achieve the same results. Variations and modifications of the present apparatus and process of the invention will be obvious to those skilled in the art and it is intended to cover in the appended claims all such modifications and equivalence. Then entire disclosures of all references, applications, patents, and publications cited above, and of the corresponding application(s), are hereby incorporated by reference.

Wherefore, what is claimed is:

1. A friction-compensated nozzle adapted to accelerate powder particles entrained in a gas to speeds sufficiently high to deposit and consolidate said powder particles on a surface of an object, said nozzle comprising:

a nozzle body defining a gas channel, wherein said gas channel comprises, a converging section configured to receive the powder particles and gas mixture, a diverging tapered outlet section, and a throat section of constant cross-sectional area connecting said converging section;

wherein the powder particles and gas mixture is received in the converging section of the gas channel at a first velocity and the gas is accelerated as it passes through the converging section to a second velocity which is at or below the sonic velocity;

and wherein the divergence of said diverging tapered outlet section of said gas channel maintains the gas at a substantially constant velocity equal to said second velocity as it flows through the outlet section.

2. The friction-compensated nozzle according to claim 1, wherein the gas channel has a circular axisymmetric cross-section along its length.

3. The friction-compensated nozzle according to claim 1, wherein the tapered outlet section has circular axisymmetric cross section along its length.

4. The friction-compensated nozzle according to claim 1, wherein the tapered outlet section has a cross-sectional shape which is unequal in two orthogonal directions.

5. The friction-compensated nozzle according to claim 4, wherein the tapered outlet section has one of (i) an elliptical cross-section or (ii) a chamfer-radius rectangular cross section, along its length.

6. The friction-compensated nozzle according to claim 1, wherein the powder particles and gas mixture that flows out of the tapered outlet section of the nozzle is confined to a narrow cross sectional area jet at slightly less than sonic velocity to prevent unwanted supersonic expansion of the jet for a large range of nozzle to surface of object standoff distances and to reduce influx of unwanted gas into the nozzle gas stream and deposition region.

7. The friction-compensated nozzle according to claim 1, wherein the nozzle body is further configured to provide an inert gas shield to reduce influx of unwanted gas into the nozzle gas stream and deposition region.

8. The friction-compensated nozzle according to claim 1, wherein the converging section of the gas channel has a length to diameter ratio of at least 10:1.

9. The friction-compensated nozzle according to claim 8, wherein the converging section of the gas channel has a length to diameter ratio of approximately 40:1.

10. A particulate deposition device adapted for accelerating powder particles entrained in a gas to speeds sufficiently high to deposit and consolidate said powder particles on a surface of an object, comprising:

a friction-compensated nozzle comprising a nozzle body defining a gas channel, wherein said gas channel comprises, a converging section configured to receive the powder particles and gas mixture, a diverging tapered outlet section, and a throat section of constant cross-sectional area connecting said converging section, wherein the powder particles and gas mixture is received in the converging section of the gas channel at a first velocity and the gas is accelerated as it passes through the converging section to a second velocity which is at or below the sonic velocity, and wherein the divergence of said diverging tapered outlet section of said gas channel maintains the gas at a substantially constant velocity equal to said second velocity as it flows through the outlet section; and an outer evacuator chamber surrounding the friction-compensated nozzle, wherein the outer evacuator chamber entrains and retrieve excess powder particles and gas out through said outer evacuator chamber.

11. The particulate deposition device according to claim 10, wherein the outer evacuator chamber comprises an outer evacuator nozzle disposed within the evacuator chamber, wherein said outer evacuator nozzle comprises a channel within which the friction-compensated nozzle resides.

12. The particulate deposition device according to claim 11, wherein the outer evacuator nozzle forms a fluid dynamic coupling with the friction-compensated nozzle and the object upon which the powder particles deposit to entrain and retrieve excess powder particles and retrieve gas out through the evacuator nozzle, the outer evacuator nozzle being configured to form a gas turning angle between an exit of the friction-compensated nozzle and the object upon which the powder particles deposit for aspiration of said excess powder particles when said gas turns through said turning angle, and wherein said fluid dynamic coupling aspirates said excess powder particles through the evacuator nozzle.

13. A particulate deposition device adapted for accelerating powder particles entrained in a gas to speeds sufficiently high to deposit and consolidate said powder particles on a surface of an object, comprising:

a friction-compensated nozzle comprising a nozzle body defining a gas channel, wherein said gas channel comprises, a converging section configured to receive the powder particles and gas mixture, a diverging tapered outlet section, and a throat section of constant cross-sectional area connecting said converging section, wherein the powder particles and gas mixture is received in the converging section of the gas channel at a first velocity and the gas is accelerated as it passes through the converging section to a second velocity which is at or below the sonic velocity, and wherein the divergence of said diverging tapered outlet section of said gas channel maintains the gas at a substantially constant velocity equal to said second velocity as it flows through the outlet section; and a powder fluidizing unit attached to the converging section of the nozzle which delivers said powder particles entrained in said gas.

14. The particulate deposition device according to claim 13 wherein said powder fluidizing unit comprises:

a hopper configured to contain a level of the powder particles;

an inlet port open to the hopper above said level, wherein the inlet port introduces a first gaseous stream into the hopper;

a mixer coupled to the hopper which entrains the powder particles in the gas to create said mixture of powder particles and gas; and an outlet port coupled to the hopper above said level of the powder particles which allows the mixture to exit from the hopper.

15. The particulate deposition device according to claim 14 wherein the mixer comprises an agitator.

16. The particulate deposition device according to claim 15 wherein the agitator comprises an auger.

17. The particulate deposition device according to claim 14 wherein the mixer comprises at least one fluidizing port open to the hopper below said level of the powder particles and configured to introduce a second gaseous stream into the hopper to form said mixture.

18. The particulate deposition device according to claim 17 wherein the mixer comprises a plurality of fluidizing ports coupled to the hopper at different distances beneath said level of the powder particles.

19. The particulate deposition device according to claim 17 wherein the mixer further comprises a movable fluidizing port positioned and maintained below the powder particle level in said hopper.

20. The particulate deposition device according to claim 14 wherein the powder fluidizing unit further comprises a treatment system configured to treat said mixture of powder particles in the gas to modify a property of said mixture.

21. The particulate deposition device according to claim 20 wherein the treatment system comprises at least one fluidizing port coupled to the hopper below said level of the powder particles and configured to introduce a second gaseous stream comprising a treating gas into the hopper to treat said mixture.

22. The particulate deposition device according to claim 20 wherein the treatment system comprises a cavity having a cavity inlet port configured to receive said mixture from said hopper and wherein said cavity has a cavity outlet port adapted to convey said mixture to the nozzle, said cavity inlet port and said cavity outlet port being configured and positioned on said cavity to provide a desired concentration of said powder particles in said gas.

23. The particulate deposition device according to claim 20 wherein the treatment system comprises a sieve positioned to receive said mixture of powder particles and gas and filter said mixture.

24. The particulate deposition device according to claim 20 wherein the treatment system has an outer jacket positioned in a surrounding relationship to a portion of the treatment system and configured to provide at least one selected from the group consisting of heating and cooling to said mixture of powder particles and gas.

25. The particulate deposition device according to claim 20 wherein at least a portion of said system is adapted to be treated with radiation to cause said mixture to become radioactive.

26. The particulate deposition device according to claim 20 wherein the treatment system comprises baffles configured to modify mixing of the powder particles and the gas.

27. The particulate deposition device according to claim 26 wherein the baffles are configured to receive electrical power from an electrical power source and triboelectrically charge the powder particles.

28. The particulate deposition device according to claim 20 wherein the treatment system comprises a heat exchanger.

29. The particulate deposition device according to claim 28 wherein the heat exchanger comprises an induction coil.

30. The particulate deposition device according to claim 28 wherein the heat exchanger comprises a set of radiator panels positioned to cool said carrier gas with entrained powder particles, said radiator panels being cooled by a set of cooling coils.

31. The particulate deposition device according to claim 28 wherein the heat exchanger comprises a set of radiator panels positioned to heat said carrier gas with entrained powder particles, said radiator panels being heated by a set of electrical resistive coils.

32. The particulate deposition device according to claim 31 wherein the treatment system comprises a means of coating the powder particles entrained in the gas by evaporating material from said radiator panels.

33. The particulate deposition device according to claim 13 and further comprising a thermal treatment system configured to heat said powder particles to a temperature below the melting point of the powder particles.

34. A particulate deposition device adapted for accelerating powder particles entrained in a gas to speeds sufficiently high to deposit and consolidate said powder particles on a surface of an object, comprising:

a friction-compensated nozzle comprising a nozzle body defining a gas channel, wherein said gas channel comprises, a converging section configured to receive the powder particles and gas mixture, a diverging tapered outlet section, and a throat section of constant cross-sectional area connecting said converging section, wherein the powder particles and gas mixture is received in the converging section of the gas channel at a first velocity and the gas is accelerated as it passes through the converging section to a second velocity which is at or below the sonic velocity, and wherein the divergence of said diverging tapered outlet section of said gas channel maintains the gas at a substantially constant velocity equal to said second velocity as it flows through the outlet section; and a thermal treatment system which heats said powder particles to a temperature below the melting point of the powder particles.

35. The particulate deposition device according to claim 34 wherein the thermal treatment system comprises a radio frequency generator that generates a thermal plasma through which said powder particles traverse to form thermal-plastic conditioned powder particles.

36. The particulate deposition device according to claim 34 wherein the thermal treatment system comprises a radio frequency generator that generates a thermal plasma in chamber through which said gas is heated to form thermal-plastic conditioned powder particles injected downstream of the thermal plasma.

* * * * *

UNITED STATES PATENT AND TRADEMARK OFFICE

CERTIFICATE OF CORRECTION

PATENT NO. : 6,915,964 B2
DATED : July 12, 2005
INVENTOR(S) : Tapphorn et al.

It is certified that error appears in the above-identified patent and that said Letters Patent is hereby corrected as shown below:

Column 17,
Line 28, "ρt" should be changed to -- $\rho_t$ --.

Signed and Sealed this

Eleventh Day of October, 2005

JON W. DUDAS
*Director of the United States Patent and Trademark Office*

UNITED STATES PATENT AND TRADEMARK OFFICE

CERTIFICATE OF CORRECTION

PATENT NO. : 6,915,964 B2
DATED : July 12, 2005
INVENTOR(S) : Tapphorn et al.

It is certified that error appears in the above-identified patent and that said Letters Patent is hereby corrected as shown below:

Column 17,
Line 45, the equation should appear as follows:

-- $$\rho = \frac{\rho_1}{\left[1 + \frac{(\gamma - 1)}{2} \cdot M^2\right]^{(1/(\gamma-1))}} \quad (3)$$ --.

Signed and Sealed this

Thirteenth Day of June, 2006

JON W. DUDAS
*Director of the United States Patent and Trademark Office*